US011377250B2

(12) United States Patent
Le Reverend et al.

(10) Patent No.: US 11,377,250 B2
(45) Date of Patent: Jul. 5, 2022

(54) LIQUID DISPENSING APPARATUS

(71) Applicant: SOCIETE DES PRODUITS NESTLE S.A., Vevey (CH)

(72) Inventors: Benjamin Le Reverend, Kirkwood, MO (US); Raphael Thivolet, Vittel (FR); Sarah Brulhart, Bulle (CH); Daniel Grolimund, Bolligen (CH); Ashley Hunt, Alfreton (GB)

(73) Assignee: Societe des Produits Nestle S.A., Vevey (CH)

( * ) Notice: Subject to any disclaimer, the term of this patent is extended or adjusted under 35 U.S.C. 154(b) by 116 days.

(21) Appl. No.: 16/624,135

(22) PCT Filed: Jun. 19, 2018

(86) PCT No.: PCT/EP2018/066193

§ 371 (c)(1),
(2) Date: Dec. 18, 2019

(87) PCT Pub. No.: WO2018/234275

PCT Pub. Date: Dec. 27, 2018

(65) Prior Publication Data

US 2020/0130884 A1 Apr. 30, 2020

(30) Foreign Application Priority Data

Jun. 21, 2017 (EP) ..... 17177213

(51) Int. Cl.

| | |
|---|---|
| ***B65D 1/04*** | (2006.01) |
| ***B65D 25/48*** | (2006.01) |
| ***B65D 47/06*** | (2006.01) |
| ***B65D 47/20*** | (2006.01) |
| ***B65D 81/32*** | (2006.01) |

(Continued)

(52) U.S. Cl.

CPC ..... *B65D 1/04* (2013.01); *B65D 25/48* (2013.01); *B65D 47/06* (2013.01); *B65D 47/205* (2013.01);

(Continued)

(58) Field of Classification Search

CPC .. B65D 1/04; B65D 81/3211; B65D 81/3205; B65D 83/0055; B65D 85/72; B65D 25/48; B65D 47/12; B65D 47/122; B65D 47/06

(Continued)

(56) References Cited

U.S. PATENT DOCUMENTS 132,020 A * 10/1872 Odell ..... B65D 1/04 215/6
3,729,553 A * 4/1973 Gold et al. ..... A61Q 11/00 424/44

(Continued)

FOREIGN PATENT DOCUMENTS

| | | |
|---|---|---|
| EP | 0979782 | 2/2000 |
| GB | 2525847 | 11/2015 |
| WO | 2006055508 | 5/2006 |

*Primary Examiner* — Robert J Hicks
(74) *Attorney, Agent, or Firm* — K&L Gates LLP

(57) ABSTRACT

A liquid dispensing apparatus may include a first container containing a first liquid and a second container containing a second liquid. The first and second containers each can have an opening in an end. One of the first liquid and the second liquid can contain a tastant which is essentially absent from the other liquid or is present in a relatively differing amount. When the first and the second liquids are poured from the apparatus, the first liquid flows through the opening in the end of the first container and the second liquid flows through the opening in the end of the second container, such that the first liquid begins to exit the opening in the end of the first container before the second liquid begins to exit the opening in the end of the second container.

15 Claims, 11 Drawing Sheets

(51) Int. Cl.
*B65D 85/72* (2006.01)
*B65D 83/00* (2006.01)

(52) U.S. Cl.
CPC ..... *B65D 81/3211* (2013.01); *B65D 81/3283* (2013.01); *B65D 83/0055* (2013.01); *B65D 85/72* (2013.01); *B65D 2205/02* (2013.01); *B65D 2547/06* (2013.01)

(58) Field of Classification Search
USPC ..... 220/524, 525, 523; 215/6
See application file for complete search history.

(56) References Cited

U.S. PATENT DOCUMENTS

| | | | | |
|---|---|---|---|---|
| 4,410,085 | A | 10/1983 | Beneziat et al. | |
| 5,607,072 | A * | 3/1997 | Rigney | B65D 1/04 206/431 |
| 6,179,146 | B1 * | 1/2001 | Betras | B65D 21/0204 215/229 |
| 6,665,048 | B2 * | 12/2003 | Gelbart | G03B 21/008 353/122 |
| 6,913,777 | B2 * | 7/2005 | Rebhorn | B65B 29/10 206/217 |
| 2003/0173364 | A1 | 9/2003 | Eva et al. | |
| 2007/0175930 | A1 * | 8/2007 | Heisner | B65D 23/12 222/538 |
| 2010/0000887 | A1 * | 1/2010 | Troesch | B65D 51/2821 206/219 |
| 2013/0001111 | A1 * | 1/2013 | Knutsen | B65D 1/04 206/222 |
| 2014/0224692 | A1 * | 8/2014 | Boghossian | A61K 8/922 206/438 |

* cited by examiner

LIQUID DISPENSING APPARATUS

CROSS REFERENCE TO RELATED APPLICATIONS

The present application is a National Stage of International Application No. PCT/EP2018/066193, filed on Jun. 19, 2018, which claims priority to European Patent Application No. 17177213.0, filed on Jun. 21, 2017, the entire contents of which are being incorporated herein by reference.

FIELD

The present teachings relate to a liquid dispensing apparatus and in particular but not exclusively to a liquid dispensing apparatus for dispensing different liquids.

BACKGROUND

There is interest in being able to enhance the taste perception of tastants such as sugar (sucrose) and salt (sodium chloride) so as to provide equivalent taste impression in foods and beverages but using lower levels of addition. The World Health Organization (WHO) recommends reducing intake of salt and sugar in developed countries down to 2 g of sodium and 50 g of sugar per capita per day.

Examples of devices capable of containing and dispensing more than one liquid are seen in GB432400A, EP3033297A1, US2016114942A, EP1628885A1, CN2658077Y, EP2653405A1, CN202717089U and US2007075079A.

SUMMARY

Particular aspects and embodiments are set out in the appended claims.

Viewed from a first aspect, the present teachings can provide an apparatus for containing and dispensing liquids which enhance taste perception of tastants such as salt and sugar.

In a particular approach, there can be provided a liquid dispensing apparatus. The liquid dispensing apparatus comprises a first container containing a first liquid. The first container has an opening in an end of the first container. The liquid dispensing apparatus also comprises a second container adjacent to the first container. The second container contains a second liquid and the second container has an opening in an end of the second container. The opening in the end of the first container is proximate to the opening in the end of the second container. The first container and the second container separate the first liquid from the second liquid. One of the first liquid and the second liquid contains a tastant which is essentially absent from the other liquid or is present in a relatively differing amount. The arrangement of the first container and the second container, and/or the arrangement of the opening in the end of the first container and the opening in the end of the second container is that, when the first and the second liquids are poured from the apparatus, the first liquid flows through the opening in the end of the first container and the second liquid flows through the opening in the end of the second container, such that the first liquid begins to exit the opening in the end of the first container before the second liquid begins to exit the opening in the end of the second container. A tastant "essentially absent" from a liquid may for example be present at a concentration below the threshold for perception of that tastant. The perception threshold varies according to the tastant; for high intensity sweeteners it is a very small quantity. A tastant "essentially absent" from a liquid may for example be present at a concentration below 10% of the $EC_{50}$ value. The $EC_{50}$ value is the concentration at which the tastant gives half the maximal response. In the situation where the tastant is sucrose, "essentially absent" may be considered concentrations below 10 mM. In the context of the current invention, two liquids containing "relatively differing" amounts of tastant may refer to the two liquids having concentrations of the tastant differing by at least 5%, for example at least 10%, for example at least 20%, for example at least 30%, for example at least 40%, for further example at least 50%. In the context of the current invention, the meaning of the term "adjacent" includes side-by-side, but is not limited to this.

In another particular approach, there can be provided a liquid dispensing apparatus. The liquid dispensing apparatus comprises a first container containing a first liquid. The first container has an opening in an end of the first container. The liquid dispensing apparatus also comprises a second container adjacent to the first container. The second container contains a second liquid and the second container has an opening in an end of the second container. The opening in the end of the first container is proximate to the opening in the end of the second container. A curved side wall of the first container also forms a curved side wall of the second container and the curved side wall separates the first liquid from the second liquid. One of the first liquid and the second liquid contains a tastant which is essentially absent from the other liquid or is present in a relatively differing amount. The curved side wall inhibits the flow of the second liquid from the second container such that, when the first and the second liquids are poured from the apparatus, the first liquid flows through the opening in the end of the first container and the second liquid flows through the opening in the end of the second container, such that the first liquid begins to exit the opening in the end of the first container before the second liquid begins to exit the opening in the end of the second container.

In another particular approach, there can be provided a liquid dispensing apparatus. The liquid dispensing apparatus comprises a first container containing a first liquid. The first container has an opening in an end of the first container. The liquid dispensing apparatus also comprises a second container adjacent to the first container. The second container contains a second liquid and the second container has an opening in an end of the second container. The opening in the end of the first container is proximate to the opening in the end of the second container. The first container and the second container separate the first liquid from the second liquid. One of the first liquid and the second liquid contains a tastant which is essentially absent from the other liquid or is present in a relatively differing amount. The opening in the end of the first container comprises a first valve and the opening in the end of the second container comprises a second valve and the first valve and the second valve are configured such that, when the first and the second liquids are poured from the apparatus, the first liquid flows through the first valve and the second liquid flows through the second valve, such that the first liquid begins to exit the first valve before the second liquid begins to exit the second valve.

In another particular approach, there can be provided a liquid dispensing apparatus. The liquid dispensing apparatus comprises a first container containing a first liquid. The first container has an opening in an end of the first container. The liquid dispensing apparatus also comprises a second container. The second container comprises a tube and a fluid retaining element. The fluid retaining element contains a second liquid. The tube has an opening at a first end of the tube and a second end of the tube is within the fluid retaining element. The tube passes through the first container. The opening in the end of the first container is proximate to the opening at the first end of tube of the second container. The first container and the second container separate the first liquid from the second liquid. One of the first liquid and the second liquid contain a tastant which is essentially absent from the other liquid or is present in a relatively differing amount. The arrangement of the first container and the tube of the second container are such that, when the first and the second liquids are poured from the apparatus, the first liquid flows through the opening in the end of the first container and the second liquid flows through the opening at the first end of the tube of the second container, such that the first liquid begins to exit the opening in the end of the first container before the second liquid begins to exit the opening at the first end of the tube of the second container.

Thereby, liquid dispensing apparatuses are provided that can be used to sequentially dispense first and second liquids having differing tastant concentrations for consumption by a user in a manner perceived by the user as a single continuous sip from the apparatus.

BRIEF DESCRIPTION OF THE DRAWINGS

Various example embodiments will now be described in detail by way of example only with reference to the following drawings.

DETAILED DESCRIPTION

Figure 1:
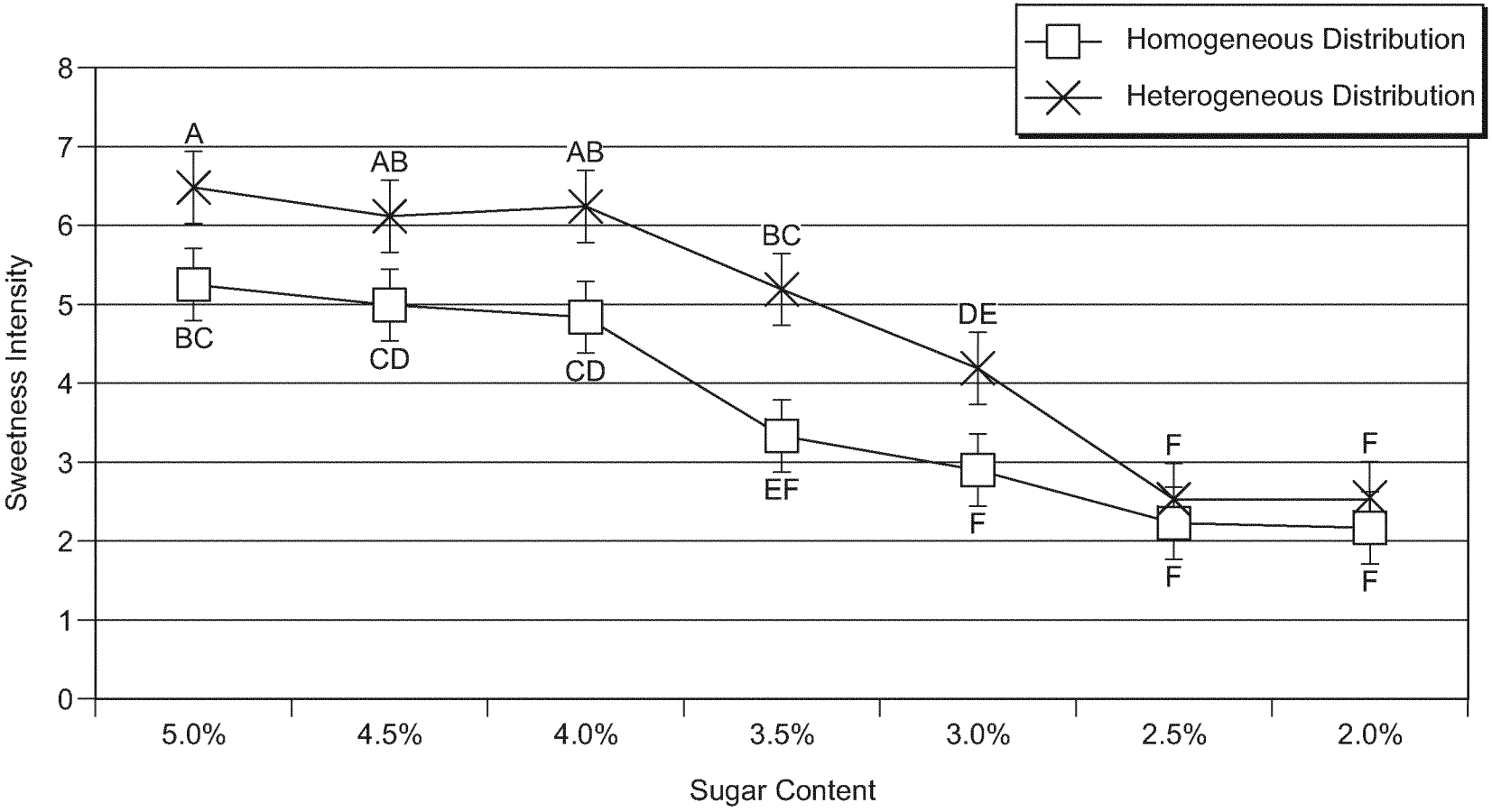
FIG. 1 is a graph of sweetness intensity vs sugar content for the enhancement of sweetness using heterogeneously distributed sucrose in a single sip.

The present disclosure relates to a liquid dispensing apparatus configured to hold and dispense multiple liquids having different tastant properties for dispensing the liquids for a user, such as a consumer. The liquids may together form a beverage for consumption (i.e. consumable) by a user. The liquids may therefore be thought of as first and second portions of the beverage. The beverage formed by the liquids may be any drink, for example a drink typically consumed hot, such as tea, coffee, hot chocolate, or soup, or a drink typically consumed cold such as iced tea, fruit juice, drinking yoghurt or milk. The beverage may be a non-carbonated beverage. Either or both of the liquids may include a neutraceutical liquid and/or a pharmaceutical liquid. The beverage may be a non-alcoholic beverage. The beverage may comprise less than 150 food calories per serving, for example less than 150 food calories per 33 cL. The beverage may comprise less than 100 food calories per serving, for example less than 100 food calories per 33 cL. The beverage may comprise less than 40 food calories per serving, for example less than 40 food calories per 33 cL.

The differing tastant properties as between the first and second liquids may be provided by either one or both of the liquids containing an amount or a relatively differing amount of a tastant. The tastant may be sweet, salty, bitter, umami, sour or have flavour. The tastant may comprise more than one component, for example a salty tastant may consist of potassium chloride and ammonium chloride. The ratio of the concentration of tastant in the first liquid to the overall concentration of tastant in the beverage may be between 3:1 and 1.1:1. For example, the first liquid may contain a tastant absent, present in smaller quantities, or present in a relatively differing amount in the second liquid, which may be applicable for tastants seen as generally positive by a user, whereas the first liquid may have an absence or reduced quantity of a tastant seen as generally negative by a user.

Part of the first and second liquids being consumable together allows a single sip of the combined beverage to comprise both liquids. The total volume of the first and second liquids dispensed from the liquid dispensing apparatus in one dispensing action may therefore be less than or equal to a natural sip volume. A natural sip volume may vary between users based upon factors such as gender, age, vessel size, cup vs. straw sipping, and sequence effects, but may be considered to be approximated by a figure of around 30 ml (see, for example, Dysphagia. 2003 Summer; 18(3):196-202). As discussed further below, various examples of the present approach provide that the liquid dispensing apparatus may dispense the liquids in such manner that a single use of the liquid dispensing apparatus dispenses some of the first and second liquids such that the user consumes the a portion of the beverage volume as a single sip.

To facilitate the differential delivery of the first and second liquids having the differing tastant content, the liquid dispensing apparatus is configured to provide that the first liquid is dispensed substantially before the second liquid. As discussed further below, there may be an overlap between ending dispensing of the first liquid and starting the dispensing of the second liquid. By the liquid dispensing apparatus performing in this manner it is provided that the liquid dispensing apparatus is able to provide a beverage or other liquid to the user in accordance with the following taste perception principles. When a liquid containing a tastant contacts the tongue before liquid without a tastant, the overall taste impression is strongly influenced by the concentration of tastant in the first liquid to encounter the tongue.

The following 3 examples provide experimental data relating to the sensory perception of sweetness and bitterness in single and multiple sips.

Example 1: Enhancement of Sweetness Using Heterogeneously Distributed Sucrose in a Single Sip A trained panel (n=12) was used to capture, through quantitative descriptive analysis, the sweetness of different samples using packaging such as a liquid dispensing apparatus as described herein. A base typical milk chocolate product was used in this example.

The Homogenous samples contained semi-skimmed milk with Y g per liter of sucrose and 40 g per liter of cocoa powder (4%), and both chambers (which could be referred to or considered as first and second containers) of the packaging were filled with this liquid composition. The Heterogeneous samples contained semi-skimmed milk with 2 times Yg per liter of sucrose and 40 g per liter of cocoa powder (4%) in the external chamber of the packaging and semi-skimmed milk 0 g per liter of sucrose (0%) and 40 g per liter of cocoa powder (4%) in the internal chamber of the packaging. Overall, the Heterogeneous samples contained semi-skimmed milk with Yg per liter of sucrose (10%) and 40 g per liter of cocoa powder (4%), just like the Homogenous samples.

Y was varied from 50 g per liter down to 20 g per liter, in decrements of 5 g per liter, leading to seven Heterogeneous and seven Homogenous samples, all described for sweetness by the trained sensory panel. For all Y sucrose content between 50 g per liter and 30 g per liter, the Heterogeneous sample was perceived as more intense than the Homogenous sample of the same concentration. The results are illustrated in FIG. 1, where two samples which are statistically different do not share the same letters. The statistical significance of the differences is visualized in FIG. 1 by displaying the error bars representing the Fisher's least significant difference (LSD) post-hoc multiple comparison analysis computed for factors with an individual error rate of 0.05 (equivalent to a 95% confidence level) (CI).

This sweetness enhancement can also be used to reduce sucrose content, without modifying perceived sweetness, since for example the Heterogeneous sample (Y=35 g per liter=3.5%) is perceived as sweet as the Homogenous sample (Y=50 g per liter=5%), corresponding to a 30% sucrose reduction.

Example 2: Bitterness Masking Using Heterogeneously Distributed Caffeine in a Single Sip A trained panel (n=12) was used to capture, through quantitative descriptive analysis, the bitterness of different samples using the described packaging. A base typical milk chocolate product was used in this example.

The samples contained semi-skimmed milk with sucrose at 50 g per liter (5%), 40 g per liter of cocoa powder (4%) and either:

- 0 g per liter of caffeine in both chambers (Reference sample);
- 0.4 g per liter of caffeine in both chambers (Homogenous Bitter);
- 0.8 g per liter of caffeine in the external chamber (Heterogeneous Bitter OUT);
- 0.8 g per liter of caffeine in the internal chamber (Heterogeneous Bitter IN).

Figure 2:
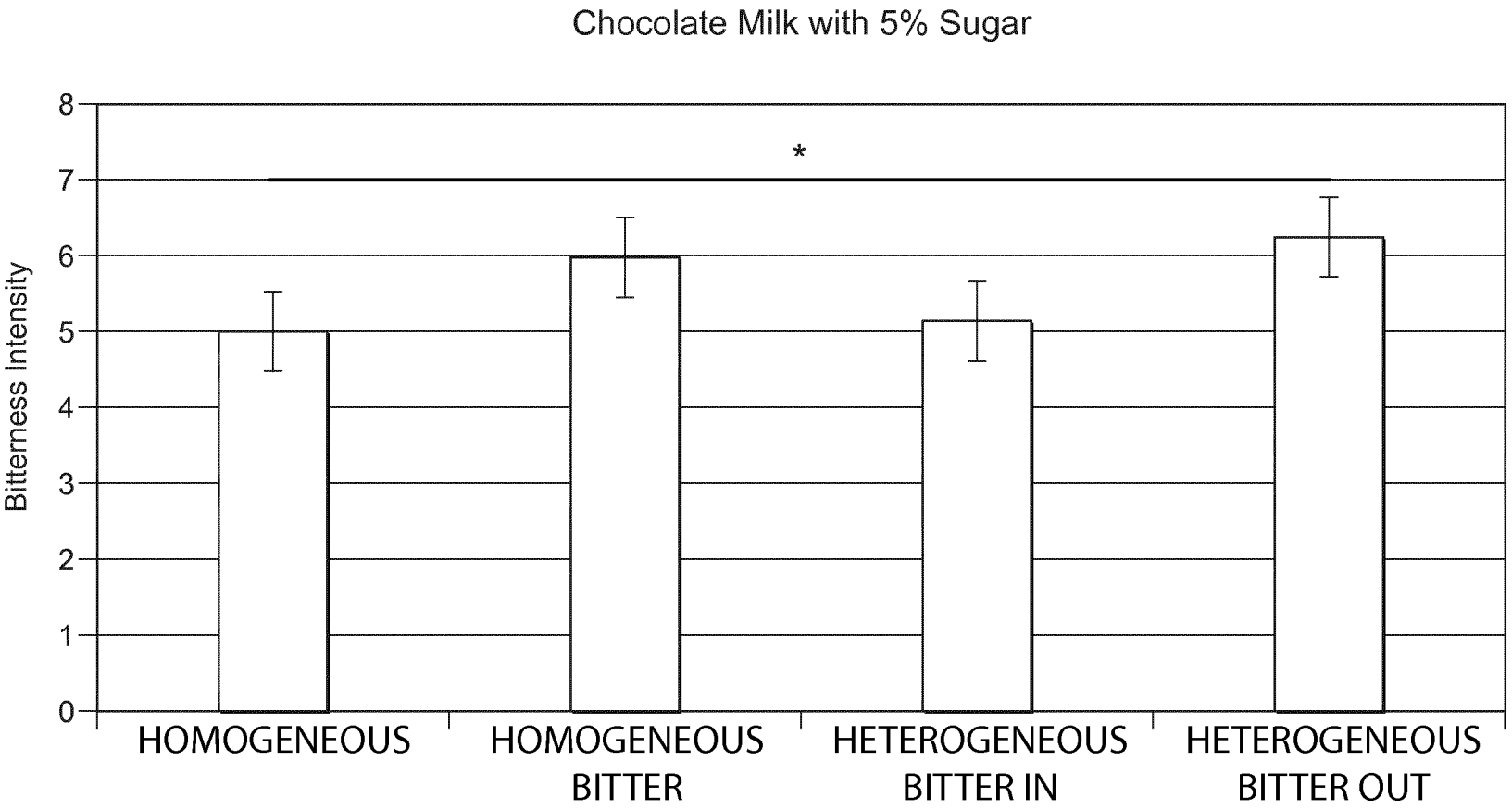
FIG. 2 is a graph of bitterness intensity for different samples of distributed caffeine in a single sip.

The results in FIG. 2 show that the samples ranked in bitterness intensity in the following order: Reference= Heterogeneous Bitter IN<Homogenous Bitter=Heterogeneous Bitter OUT. This demonstrates that the bitterness of caffeine can be reduced to the same level as the Reference sample not containing caffeine when the caffeine is located in the inner chamber (or container).

Example 3: Enhancement of Sweetness Using Heterogeneously Distributed Sucrose in a Multiple Sip Container (which May be Considered as a Vessel Having Two Containers or Chambers to Hold the Different Samples)

A trained panel (n=12) was used to capture, through quantitative descriptive analysis, the sweetness of different samples using the described packaging. A base typical milk chocolate product was used in this example.

The Reference samples contained semi-skimmed milk with 50 g per liter of sucrose (5%) and 40 g per liter of cocoa powder (4%), and both chambers of the packaging were filled with this liquid composition. A negative control reduced in sucrose by 25% contained semi-skimmed milk with 37.5 g per liter of sucrose (3.75%) and 40 g per liter of cocoa powder (4%), and both chambers of the packaging were filled with this liquid composition. The Heterogeneous samples contained semi-skimmed milk with 75 g per liter of sucrose (7.5%) and 40 g per liter of cocoa powder (4%) in the first delivery chamber of the packaging and semi-skimmed milk with 0 g per liter of sucrose (0%) and 40 g per liter of cocoa powder (4%) in the second delivery chamber of the packaging. Overall, the Heterogeneous samples contained semi-skimmed milk with 37.5 g per liter of sucrose (3.75%) and 40 g per liter of cocoa powder (4%), just like the Homogenous samples.

8 packaging prototypes containing 20 ml each (10 ml for each delivery chamber) were used to deliver 160 ml of homogenous reference, homogenous negative control with a 25% reduction of sucrose or heterogeneous prototype with 25% reduction of sucrose.

Figure 3:
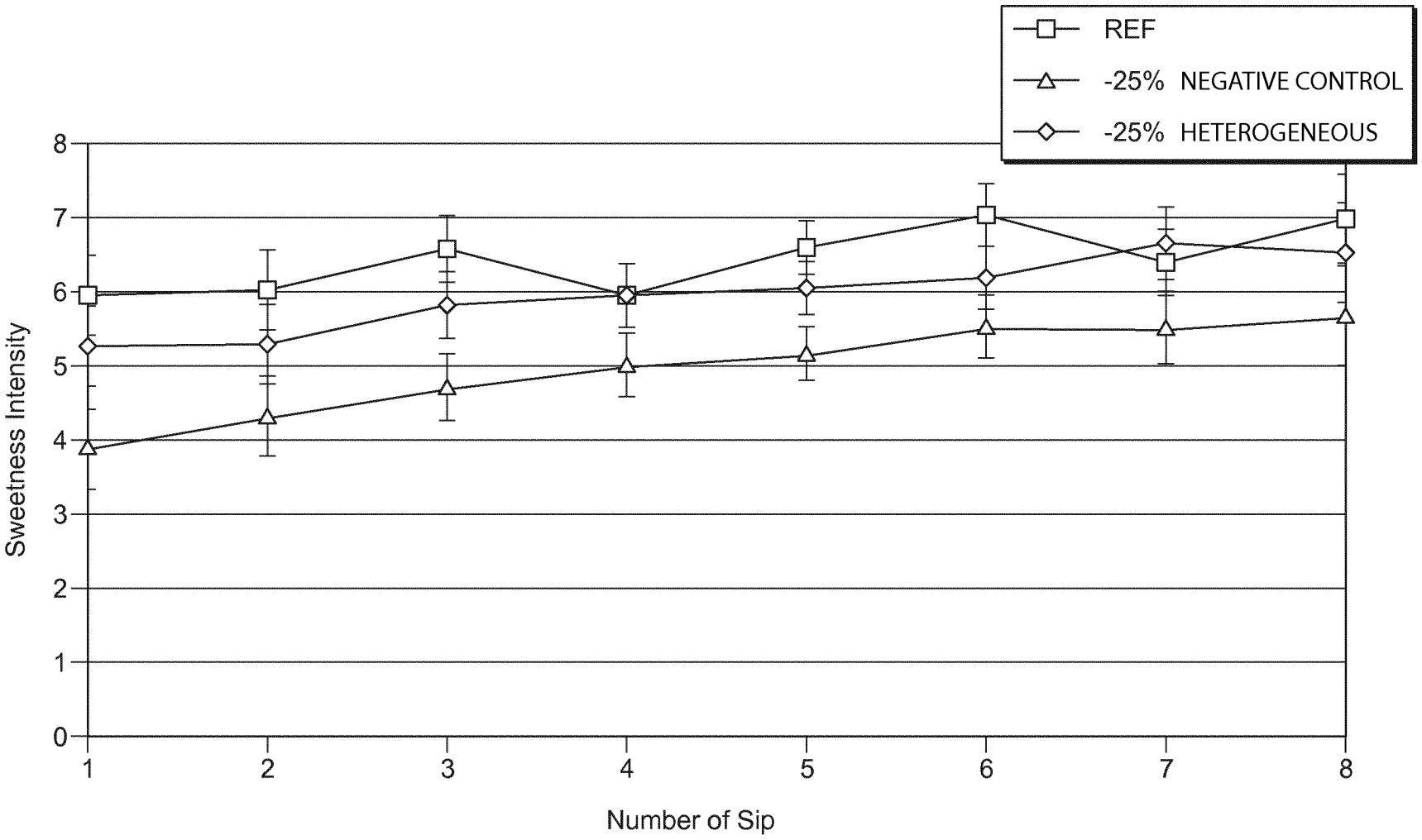
FIG. 3 is a graph of sweetness intensity vs number of sips for the enhancement of sweetness using heterogeneously distributed sucrose in a multiple sip container.

The results in FIG. 3 show that, along the 8 consecutive sips corresponding to the normal drinking behavior of a 160 ml beverage, the heterogeneous prototype is found to be not significantly less sweet than the full sugar reference, whilst the homogenous negative control with 25% less sucrose was found significantly less sweet than the reference.

Various examples of liquid dispensing apparatus and use thereof to provide delivery of first and second liquids as outlined above are now discussed with reference to FIGS. 4 to 11.

Figure 4A:
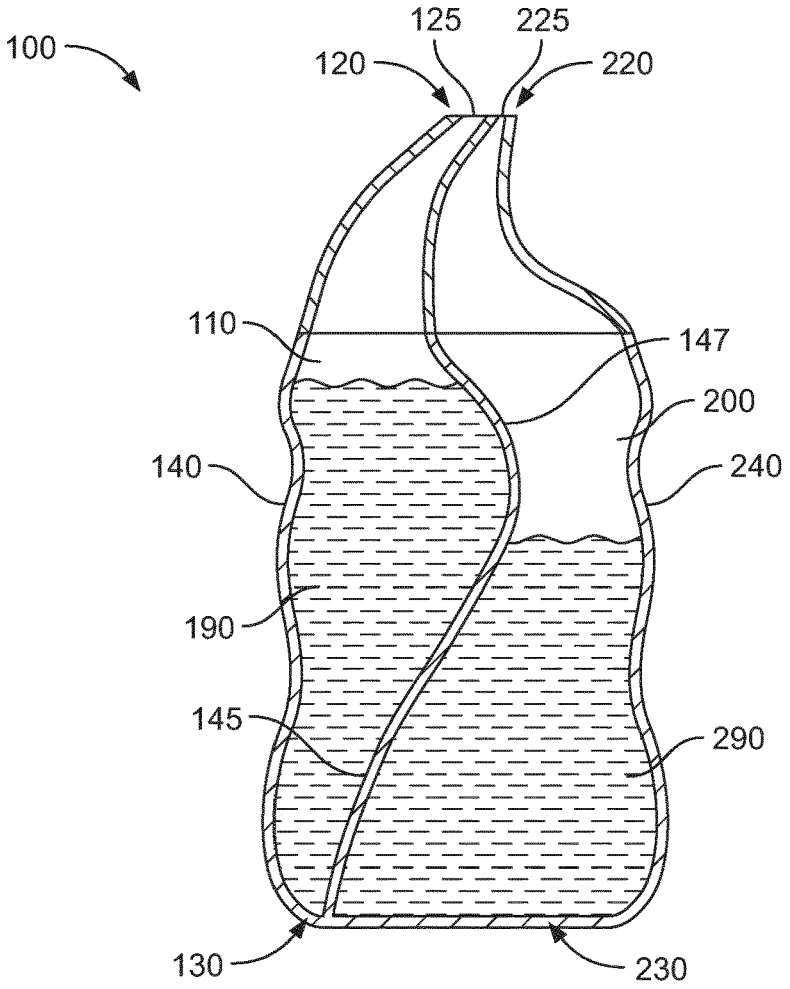
FIGS. 4A-B are schematic cross-section views of an example liquid dispensing apparatus.

FIG. 4 is a schematic cross-section view of an example liquid dispensing apparatus 100. The liquid dispensing apparatus 100 comprises a first container 110 containing a first liquid 190. The first container 110 has a first end 120 and a second end 130 opposite the first end 120. In the embodiment illustrated in the FIG. 4, the first end 120 is at the top of the first container 110 and the second end is at the bottom of the first container 110 when the first container 110 is oriented so as not to pour the first liquid 190 therefrom. The first container 110 has one or more sidewalls 140 forming an external surface of the first container 110 and the liquid dispensing apparatus 100. The first container may be circular, hexagonal or square in cross-section, or any other suitable shape.

The first end 120 of the first container 110 has an opening 125. In the present example, as illustrated in FIG. 4, the opening 125 corresponds to substantially the entire cross-sectional area of the first end 120. In alternative examples, the opening 125 may correspond to only a portion of the cross-sectional area of the first end 120, for example 10% or less, 25%, 50%, 75%, 90% or greater. In implementations where the opening 125 corresponds to less than all of the entire cross-sectional area of the first end 120, the opening 125 may be substantially in the middle of the first end 120, or it may be offset towards a side of the first end 120. The opening 125 in the first container 110 may be circular, oval, hexagonal or triangular in cross-section, or any other suitable shape to permit dispensing of liquid from within the liquid dispensing apparatus. The opening 125 may have the same or a different cross-sectional shape to the first container 110.

The liquid dispensing apparatus 100 of the present example also comprises a second container 200. The second container 200 is adjacent to the first container 110. The second container 200 contains a second liquid 290. The second container 200 has a first end 220 and a second end 230 opposite the first end 220. In the embodiment illustrated in the FIG. 4, the first end 220 is at the top of the second container 200 and the second end is at the bottom of the second container 200 when the first container 200 is oriented so as not to pour the second liquid 290 therefrom. The second container 200 has one or more sidewalls 240 forming an external surface of the second container 200 and the liquid dispensing apparatus 100. The second container may be circular, hexagonal or square in cross-section, or any other suitable shape.

The first container 110 and the second container 200 separate the first liquid 190 from the second liquid 290. In an embodiment, a side wall 145 of the first container 110 also forms a side wall 145 of the second container 200, thereby separating the first liquid 190 from the second liquid 290. One of the first liquid 190 and the second liquid 290 contains a tastant which is essentially absent from or is present in a relatively differing amount, for example in much reduced concentration relative to the other liquid.

The first end 220 of the second container 200 has an opening 225. As illustrated in FIG. 4, the opening 225 of the present example corresponds to substantially the entire cross-sectional area of the first end 220. In alternative examples, the opening 225 may correspond to only a portion of the cross-sectional area of the first end 220, for example 10% or less, 25%, 50%, 75%, 90% or greater. In implementations where the opening 225 corresponds to less than all of the entire cross-sectional area of the first end 220, the opening 225 may be substantially in the middle of the first end 220, or it may be offset towards a side of the first end 220. The opening 125 in the first end 120 of the first container 110 is proximate to the opening 225 in the first end 220 of the second container 200. The opening 225 in the second container 200 may have the same or a different cross-sectional shape to the opening 125 in the first container 110.

The arrangement of the first container 110 and the second container 200 is such that, when the first liquid 190 and the second liquid 290 are poured from the liquid dispensing apparatus 100, the first liquid 190 flows through the opening 125 in the first end 120 of the first container 110 and the second liquid 225 flows through the opening 225 in the first end 220 of the second container 200, such that the first liquid 190 begins to exit the opening 125 in the first end 120 of the first container 110 before the second liquid 290 begins to exit the opening 225 in the first end 220 of the second container 200.

Alternatively or in addition, the arrangement of the opening 125 in the first end 120 of the first container 110 and the opening 225 in the first end 220 of the second container 200 are such that, when the first liquid 190 and the second liquid 290 are poured from the liquid dispensing apparatus 100, the first liquid 190 flows through the opening 125 in the first end 120 of the first container 110 and the second liquid 225 flows through the opening 225 in the first end 220 of the second container 200, such that the first liquid 190 begins to exit the opening 125 in the first end 120 of the first container 110 before the second liquid 290 begins to exit the opening 225 in the first end 220 of the second container 200.

In the embodiment illustrated in FIG. 4, the side wall 145 of the first container 110 which also forms a side wall 145 of the second container 200 may be curved so as to inhibit the flow of the second liquid 290 from the second container 200, such that, when the first liquid 190 and the second liquid 290 are poured from the liquid dispensing apparatus 100, the first liquid 190 flows through the opening 125 in the first end 120 of the first container 110 and the second liquid 290 flows through the opening 225 in the first end 220 of the second container 200, such that the first liquid 190 begins to exit the opening 125 in the first end 120 of the first container 110 before the second liquid 290 begins to exit the opening 225 in the first end 220 of the second container 200.

Figure 4B:
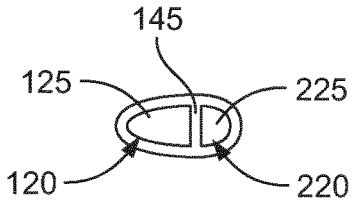

As illustrated in FIG. 4, the side wall 145 is curved into an S-shape to provide a neck in the second container 200 at point 147 which inhibits or otherwise restricts the flow of the second liquid 290 from the second container 200 when the liquid dispensing apparatus 100 is rotated in order to pour the first liquid 190 and the second liquid 290 from the liquid dispensing apparatus 100. The side wall 145 may form a curve with any number of critical points, for example an arc, double S-shape or a cubic. FIG. 4B is a cross-sectional view of the openings 125, 225 in the first end, 120, 220 of the first container 110 and second container 200 respectively. As illustrated in FIG. 4B, the opening 225 in the second container 200 has a smaller cross-sectional area than the opening 125 in the first container 110. The opening 225 in the second container 200 also has a different cross-sectional shape to the opening 125 in the first container 110. This also provides a restriction to the flow of the second liquid 290, thereby providing that the first liquid first liquid 190 begins to exit the opening 125 in the first end 120 of the first container 110 before the second liquid 290 begins to exit the opening 225 in the first end 220 of the second container 200. In the present example, the volume of the first liquid 190 in the first container 110 is greater than the volume of the second liquid 290 in the second container 200. This means that the angle the liquid dispensing apparatus 100 must be rotated through in order for the second liquid 290 to flow out of the liquid dispensing apparatus 100 is greater than the angle the liquid dispensing apparatus 100 must be rotated through in order for the first liquid 290 to flow out of the liquid dispensing apparatus 100, thereby further providing that the first liquid first liquid 190 begins to exit the opening 125 in the first end 120 of the first container 110 before the second liquid 290 begins to exit the opening 225 in the first end 220 of the second container 200.

Figure 5A:
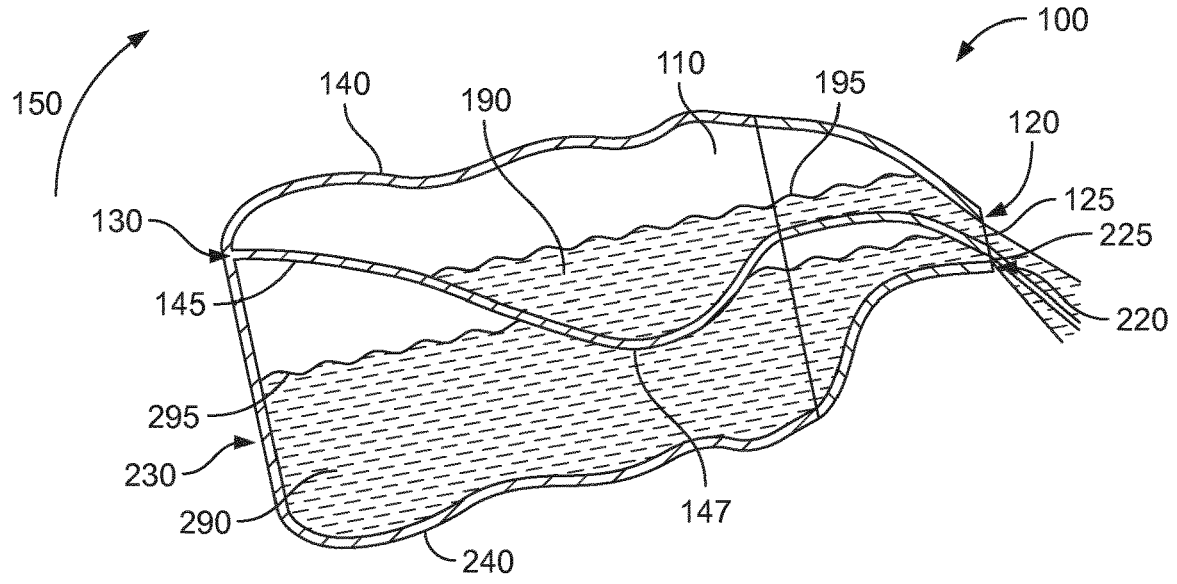
FIGS. 5A-B are a series of schematic cross-sections of the example liquid dispensing apparatus illustrated in FIG. 4 in use.

In the embodiment illustrated in FIG. 4, the side wall 145 of the first container 110 which also forms a side wall 145 of the second container 200 is curved so as to only allow a predetermined portion of the first liquid 190 to flow to and exit the opening 125 in the first end 120 of the first container 110 when the liquid dispensing apparatus 100 is rotated through a first angle. As illustrated in FIG. 5, the S-shape of the side wall 145 creates a trough or trap in the first container at point 147. When the liquid dispensing apparatus 100, as orientated in FIG. 4, is rotated in an anticlockwise direction through a first angle 150, as illustrated in FIG. 5A, the fluid level 195 of the first liquid 190 is above the side wall 145, and therefore a portion of the first liquid 190 is able to flow out of the opening 125 in the first end 120 of the first container 110. The fluid level 295 of the second fluid 290 is above the opening 225 in the first end 220 of the second container 200, and therefore the second liquid 290 is able to flow out of the opening 225 in the second end 220 of the second container 210.

Figure 5B:
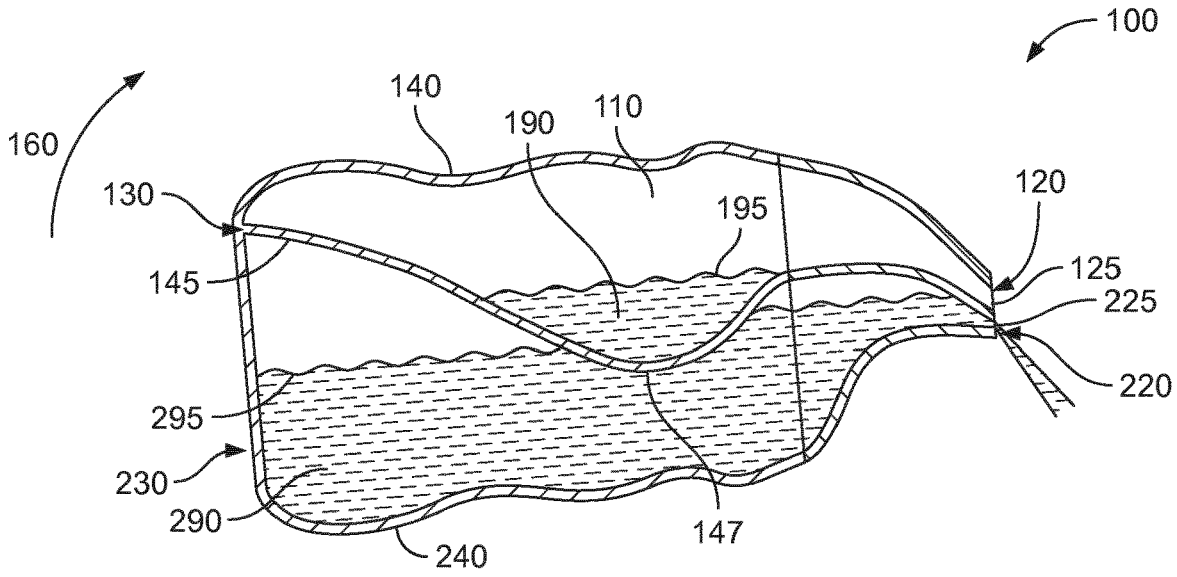

As illustrated in FIG. 5B, a second portion of the first liquid 190 collects in the trough at point 147, and is unable to flow over the side wall 145 and out of the opening 125 in the first end 120 of the first container 110. This second predetermined portion of the first liquid 190 is then allowed to flow to and exit the opening 125 in the first end 120 of the first container 110 when the liquid dispensing apparatus 100 is rotated through a second angle 160 which is greater than the first angle 150. This provides that only a portion of the first liquid 190 flows out of the liquid dispensing apparatus 100 each time that the liquid dispensing apparatus 100 is used.

When the liquid dispensing apparatus 100 is used for a first time, the liquid dispensing apparatus 100 is rotated through the first angle 150 and the first liquid 190 begins to flow out of the liquid dispensing apparatus 100 before the second liquid 290, but only a portion of the first liquid 190 is delivered whilst the second liquid continues to flow out of the liquid dispensing apparatus 100. Once the user has had their desired volume of liquid, the liquid dispensing apparatus 100 is rotated back to its original orientation. When the user wishes to use the liquid dispensing apparatus 100 for a second time, for example to have a second sip, the liquid dispensing apparatus 100 is rotated through the second angle 160, which is greater than the first angle, in order for the first liquid 190 to flow out of the liquid dispensing apparatus 100 and be delivered before the second liquid 290. When the liquid dispensing apparatus 100 is rotated through the second angle, a portion of the first liquid 190 will be contained in the trap or trough and unable to flow out of the liquid dispensing apparatus 100. Accordingly, the first liquid 190 will stop flowing out of the liquid dispensing apparatus 100 whilst the second liquid continues to flow out of the liquid dispensing apparatus 100. In order to deliver more of the first liquid from the liquid dispensing apparatus 100, the user must rotate the liquid dispensing apparatus 100 through an angle greater than the second angle. This means that a portion of the first liquid 190 will remain in the first container 110 each time the liquid dispensing apparatus 100 is used, for example when the user takes a sip of the beverage, thereby providing that a portion of the first liquid 190 is always delivered from the liquid dispensing apparatus 100 before the second liquid 290 with every sip until the second liquid 290 is depleted from the liquid dispensing apparatus 100.

In some embodiments, the first container 110 tapers towards the opening 125 in the first end 120 of the first container 110 and the second container 200 tapers towards the opening 225 in the first end 220 of the second container 200. This creates a thinning in the overall cross-sectional area of the liquid dispensing apparatus 100 towards the first end 120 of the first container 110 and the first end 220 of the second container 200, thereby creating a mouthpiece which the user can easily fit in or hold to their mouth to prevent spillage of the first liquid 190 and the second liquid 290 when pouring from the liquid dispensing apparatus 100. In an embodiment, the taper of the first container 110 and the taper in the second container 200 are asymmetric such as to promote the liquid dispensing apparatus 100 to be held in a particular orientation when the first liquid 190 and the second liquid 290 are poured from the liquid dispensing apparatus 100. As illustrated in FIG. 4, the first container 110 and the second container do not taper symmetrically about the side wall 145. The side wall 145 is curved towards the second container, whilst the side wall 240 of the second container 200 towards the first end 220 of the second container 200 is more curved than the side wall 140 of the first container 110 towards the first end 120 of the first container 110, thereby creating an symmetric end of the liquid dispensing apparatus 100. This promotes the user to hold the liquid dispensing apparatus 100 in a particular orientation and rotate the liquid dispensing apparatus 100 in a given direction to pour to the first liquid 190 and the second liquid 290 from the liquid dispensing apparatus 100 since the flow first liquid 190 and the second liquid 290 will be less inhibited when the liquid dispensing apparatus 100 is rotated in a particular direction. The taper in the first container 110 and the second container 200 also fits the mouth of the user more easily when the lower lip of the user is placed on the side wall 240 of the second container and the upper lip of the user is placed on the side wall 140 of the first container, thereby promoting the user to hold the liquid dispensing apparatus 100 in a particular orientation when the first liquid 190 and the second liquid 290 are poured from the liquid dispensing apparatus 100. The taper and curvature of the side wall 240 may also server to shape the second container 200 toward the first end 220 of the second container 200 such as to provide a trough or trap which may also serve to control the flow of the second liquid 290 from the second container 200 when the liquid dispending apparatus is rotated for a user to sip or drink the first and second liquids. The side wall 140 of the first container 110 towards the second end 130 of the first container 110 and the side wall 240 of the second container 200 towards the second end 230 of the second container 200 may also be curved or ridged to better fit the hand of a user when the liquid dispensing apparatus 100 is held in a particular orientation. For example, the side wall 140 of the first container 110 may contain a series of 4 ridges and troughs to fit the fingers of a user whilst the side wall 240 of the second container 200 may have a single ridge and trough to fit the thumb of a user, thereby promoting the user to hold the liquid dispensing apparatus 100 in a particular orientation.

In some embodiments, either or both of the opening 125 of the first container 110 and the opening 225 of the second container 200 may include a structure such as a valve to further assist with controlling the flow of the first and/or second liquids when the liquid dispensing apparatus 100 is rotated for a user to sip or drink from the apparatus. Such valves may operate to limit a maximum amount of each of the liquids dispensed during a single rotation of the liquid dispending apparatus 100. Alternatively or additionally, such valves may operate to control the sequential commencement of the dispensing of the first liquid 190 and the second liquid 290.

Figure 6:
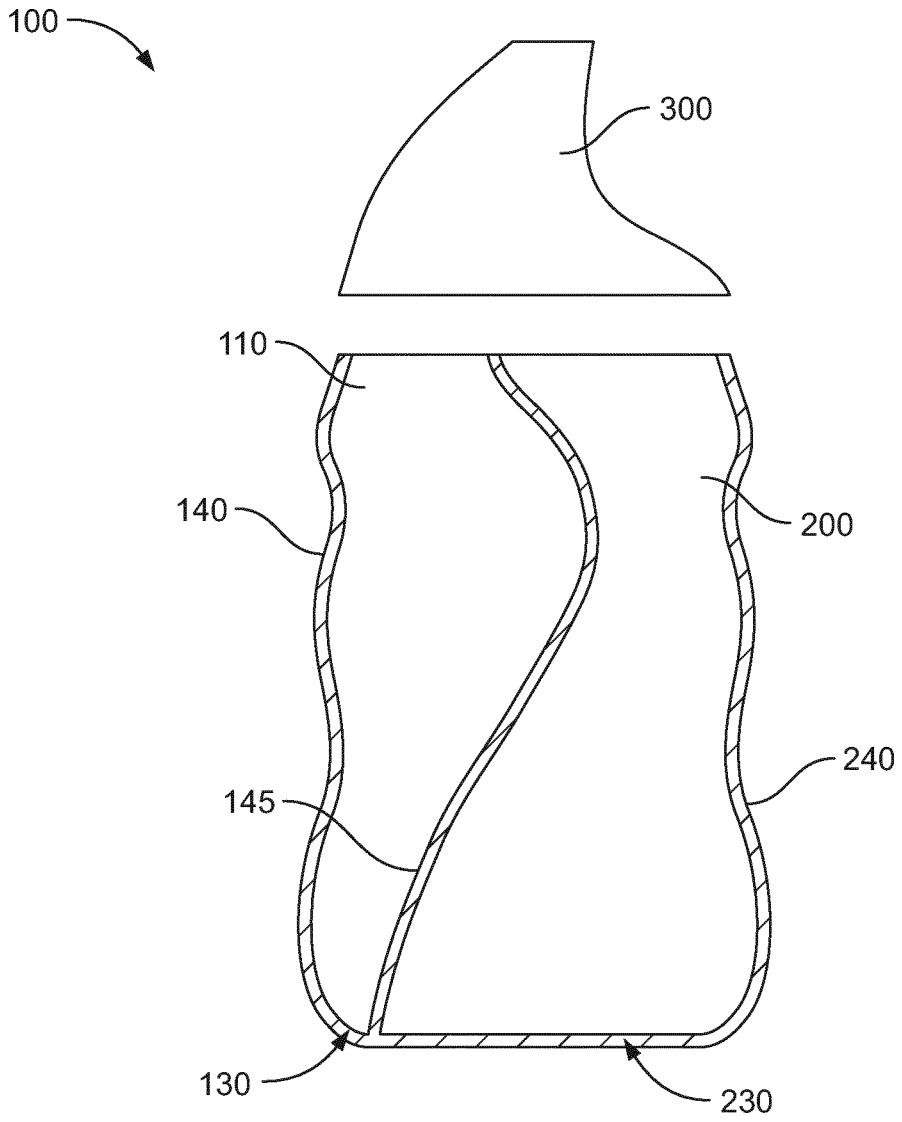
FIG. 6 is an exploded cross-section view of the example liquid dispensing apparatus illustrated in FIG. 4.

As illustrated in FIG. 6, the opening 125 in the first end 120 of the first container 110 and the opening 225 in the first end 220 of the second container 200 are located in a cap 300. The cap 300 is removable from the liquid dispensing apparatus 100 to allow the first liquid 190 in the first container 110 and the second liquid 290 in the second container 200 to be replenished when one or more of the first liquid 190 and the second liquid 290 have been depleted. The cap 300 may be attached to the remaining portion of the liquid dispensing apparatus 100 by any suitable attachment means, for example a snap-fit joint, a screw threw or a hinge mechanism with a retaining means such as a latch or clip. The external shape of the liquid dispensing apparatus 100 and/or the cross-sectional shape of the first container 110 and the second container 200 at the join between the cap 300 and the remainder of the liquid dispensing apparatus 100 may be asymmetric in order to provide that the cap can only be refitted in one orientation, thereby achieving correct orientation and use of the liquid dispensing apparatus 100 once the cap has been replaced. A portion of the cap 300 may ridges, knurls, indents or any other suitable surface texture or pattern to assist a user in gripping the cap 300 and making it easier to remove the cap 300 from the remaining portion of the liquid dispensing apparatus 100.

Thus there has now been described a first example of a liquid dispensing apparatus that can be used to sequentially dispense first and second liquids having differing tastant concentrations for consumption by a user in a manner perceived by the user as a single continuous sip from the apparatus.

Figure 7A:
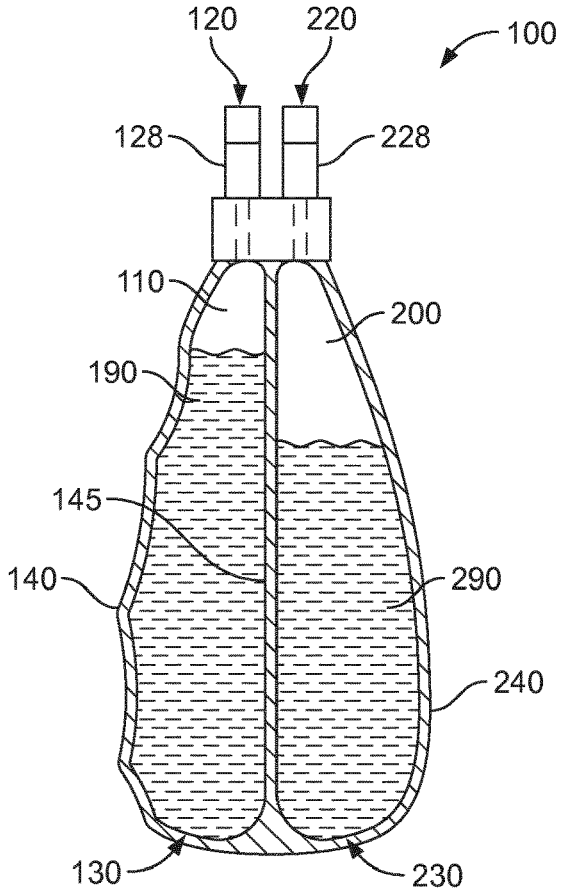
FIGS. 7A-B are schematic cross-section views of another example liquid dispensing apparatus.
Figure 7B:
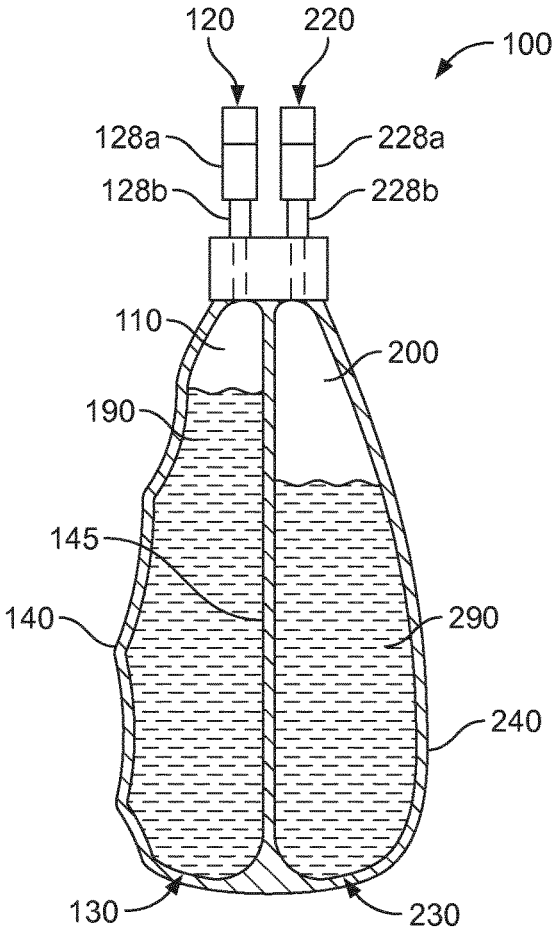

FIG. 7 is a schematic cross-section view of another example of a liquid dispensing apparatus 100, with like components shown with the same reference sign as those used in FIGS. 4-6. In the embodiment shown in FIG. 7, the side wall 145 of the first container 110 also forms a side wall 145 of the second container 200, thereby separating the first liquid 190 from the second liquid 290. Alternatively, one or both of the first container 110 and the second container 200 may be deformable bags or pouches with no common elements, thereby providing two separated containers to separate the first liquid 190 from the second liquid 290.

In the embodiment shown in FIG. 7, the opening in the first end 120 of the first container 110 comprises a first valve 128 and the opening in the first end 220 of the second container 200 comprises a second valve 228. The first valve 128 and the second valve 228 regulate the flow of the first liquid 190 and the second liquid 290, respectively, out of the liquid dispensing apparatus 100. Accordingly, the first valve 128 and the second valve 228 are configured such that, when the first liquid 190 and the second liquid 290 are poured from the liquid dispensing apparatus 100, the first liquid 190 flows through the first valve 128 and the second liquid 290 flows through the second valve 228, such that the first liquid 190 begins to exit the first valve 128 before the second liquid 290 begins to exit the second valve 228.

Each of the first valve 128 and the second valve 228 has an open position and a closed position. In the open position, liquid is able to pass through the valve, whilst is in the closed position no liquid is able to pass through the valve. FIG. 6A illustrates the first valve 128 and the second valve 228 in their respective closed positions whilst FIG. 6B illustrates the first valve 128 and the second valve 228 in their respective open positions. The valves illustrated in FIGS. 6A and 6B are of a cap type with an outer portion 128*a*, 228*a* and an inner portion 128*b*, 228*b*, wherein the valve is transitioned from the closed position to the open position by sliding or rotating the outer portion 128*a*, 228*a* relative to the respective inner portion 128*b*, 228*b*, thereby creating a gap or hole through which liquid can flow. Alternatively, the valves may be diaphragm valves, where the transition from the closed position to the open position is performed by displacing a diaphragm. Alternatively, the valves may be ball valves, check valves, butterfly valves or any other suitable type of valve. The first valve 128 may be the same type of valve as the second valve 228 or a different type of valve.

The first valve 128 and the second valve 228 may be configured such that the maximum flow of the first liquid 190 through the first valve 228 is greater than the maximum flow of the second liquid 290 through the second valve 228. For example, the size of the opening of the first valve 128 when the first valve 128 is in the open position may be larger than the size of the opening of the second valve 228 when the second valve 228 is in the open, thereby allowing more of the first liquid 190 to flow through the first valve 128 than the second fluid 290 through the second valve 228, thus achieving a higher maximum flow.

In some embodiments, the first valve 128 is configured to transition from the open position to the closed position and/or from the closed position to the open position at that same time as the second valve 228. For example, the first valve and the second valve may form part of a composite valve such that the first valve and the second valve are configured to transition from the open position to the closed position simultaneously and from the closed position to the open position simultaneously. This means that the user only has to operate a single valve, thereby reducing the risk of misuse of the liquid dispensing apparatus. For example, the cap type valves illustrated in FIGS. 6A and 6B may have an integral or common outer portion 128*a*, 228*a*, such that sliding or rotating the single outer portion 128*a*, 228*a* causes both the first valve 128 and the second valve 228 to transition from the open position to the closed position and from the closed position to the open position.

Alternatively, the first valve 128 may be configured to transition from the open position to the closed position and/or from the closed position to the open position faster than the second valve 228. For example, the cap type valves illustrated in FIGS. 6A and 6B may be configured such that the distance the outer portion 128*a* of the first valve 128 must be slid or rotated relative to the inner portion 128*b* of the first valve 128 in order to transition from the closed position to the open position and vice versa is less than the distance the outer portion 228*a* of the second valve 228 must be slid or rotated relative to the inner portion 228*b* of the second valve 228 in order to transition from the closed position to the open position and vice versa, thereby providing that the gap created in the first valve 128 is opened and closed faster than the gap created in the second valve 228. Alternatively, if the first valve 128 and the second valve 228 are diaphragm type valves, the first valve 128 is configured to require a lower pressure in order to offset the diaphragm than the second valve 228, thereby providing that the first valve transitions from the closed position to the open position and vice versa faster than the second valve. In these embodiments, when the user begins to open the first valve 128 and the second valve 228, the first valve 128 will transition to the open position before the second valve 228, thereby causing the first liquid 190 to begin to flow through the first valve 128 before the second liquid 290 begins to flow through the second valve 228.

In some embodiments, the first valve 128 is configured to only allow a predetermined portion of the first liquid 190 exit the first valve 128. Additionally or alternatively, the second valve 228 is configured to only allow a predetermined portion of the second liquid 290 exit the second valve 228. The predetermined portion of the first liquid 190 may be less than the predetermined portion of the second liquid 290, greater than or equal to the predetermined portion of the second liquid 290. For example, the predetermined portion of the first liquid 190 may be less than the predetermined portion of the second liquid 290, thereby providing that the first liquid 190 stops flowing through the first valve 128 before the second liquid 290 stops flowing through the second valve 228. The predetermined portion of the second liquid 290 may correspond to a single sip of mouthful for an average user, thereby regulating the amount of beverage that the user can receive with each use. For example, when the user wishes to take a sip or mouthful from the liquid dispensing apparatus 110, they can put the first valve 128 and the second valve 228 near or in their mouth and activate the valve, for example by sliding or rotating the outer portions 128*a*, 228*a* relative to the inner portions 228*a*, 228*b* or by changing the pressure across the first valve 128 and the second valve 228, for example by squeezing the side walls 140 of the first container 110 and the side walls 240 of the second container 200 or by sucking on the first end 120 of the first container 110 and the first end 220 of the second container 200. Since the first valve 128 is configured to transition from the closed position to the open position faster than the second valve 228, the first liquid 190 will to begin to flow through the first valve 128 before the second liquid 290 begins to flow through the second valve 228. Once the predetermined portion of the first liquid 190 has exited the first valve 128, the first liquid 190 will stop flowing through the first valve 128 whilst the second liquid 290 will continue to flow through the second valve 228 until the predetermined portion of the second liquid 290 has exited the second valve 228. At this point, no more liquid will exit the liquid dispensing apparatus. In this example, in order to dispense more liquid, the user must transition the first valve 128 and the second valve 228 from the open position to the closed position and then repeat the process again. The user can continue to repeat this process in order to receive predetermined portions of the first liquid 190 and the second liquid 290 until one or more of the first liquid 190 and the second liquid 290 has been depleted from the first container 110 and the second container 200 respectively.

In some embodiments, one or more of the first valve and the second valve are biased in the closed position. For example, a force may be required to transition the first valve 128 and the second valve from the closed position to the open position, but the first valve 128 and the second valve 228 will returned to the closed position automatically when the force is removed. In the case of a cap type valve, the outer portion 128*a*, 228*a* may be sprung such that the outer portion 128*a*, 228*a* remains in the closed position when no force is applied.

In some embodiments, a pressure difference across the valve is required in order to overcome the bias. In the case of a diaphragm valve, the diaphragm may be configured to remain in the closed position little or no pressure is applied. In this example, a pressure difference across the valve must then be applied in order to transition the diaphragm from the closed position to the open position. When the pressure difference is removed, the diagram will transition from the open position to the closed position automatically. The side walls 140, 145, 240 of the first container 110 and/or the second container 200 may be resiliently deformable such that the side walls 140, 145, 240 can be squeezed together and inwards by a user into order to reduce the volume of the first container 110 and the second container 200, thereby providing a pressure difference across the first valve 128 and the second valve 228 such that the first valve 128 and the second valve 228 transition to their respective open positions, thereby allowing the first liquid 190 to flow out of the first valve 128 and the second liquid 290 to flow out of the second valve 228. When the user stops squeezing or removes the force from the side walls 140, 145, 240, the side walls return to their original shape and configuration, thereby returning the first container 110 and the second container 200 back to their original volume and thus removing the pressure difference across the first valve 128 and the second valve 228 such that the first valve 128 and the second valve 228 transition back to their respective closed positions automatically, preventing the first liquid 128 and the second liquid 228 from flowing out of the liquid dispensing apparatus 100. This allows the user to control the amount of beverage that they receive from each use of the liquid dispensing apparatus 100, as the user is able to squeeze the liquid dispensing apparatus 100 in order to commence the flow of the first liquid 190 and the second liquid 290 from the liquid dispensing apparatus 100, then stop the flow of the first liquid 190 and the second liquid 290 from the liquid dispensing apparatus 100 when they have had the desired amount of beverage, for example a sip or a mouthful. The first valve 128 and the second valve 228 being biased in the closed position also prevents spillage of the first liquid 190 and the second liquid 290 from the liquid dispensing apparatus 100, since the liquid dispensing apparatus 100 can be held in any orientation without any liquid from flowing out of the liquid dispensing apparatus 100. Only by applying a force to overcome the bias will liquid flow out of the liquid dispensing apparatus 100.

As illustrated in FIG. 8, the first valve 128 and the second valve 228 are located in a cap 300. The cap 300 is removable from the liquid dispensing apparatus 100 to allow the first liquid 190 in the first container 110 and the second liquid 290 in the second container 200 to be replenished when one or more of the first liquid 190 and the second liquid 290 have been depleted. In some examples, such as where the first container 110 and the second container 200 are deformable bags or pouches, the replenishment may take the form of replacing either or both bags or pouches. The cap 300 may be attached to the remaining portion of the liquid dispensing apparatus 100 by any suitable attachment means, for example a snap-fit joint, a screw threw or a hinge mechanism with a retaining means such as a latch or clip. The external shape of the liquid dispensing apparatus 100 and/or the cross-sectional shape of the first container 110 and the second container 200 at the join between the cap 300 and the remainder of the liquid dispensing apparatus 100 may be asymmetric in order to providing that the cap can only be refitted in one orientation, thereby providing that the first valve 128 is connected to the first container 110 and the second valve 228 is connected to the second container 200. A portion of the cap 300 may ridges, knurls, indents or any other suitable surface texture or pattern to assist a user in gripping the cap 300 and making it easier to remove the cap 300 from the remaining portion of the liquid dispensing apparatus 100.

Figure 8A:
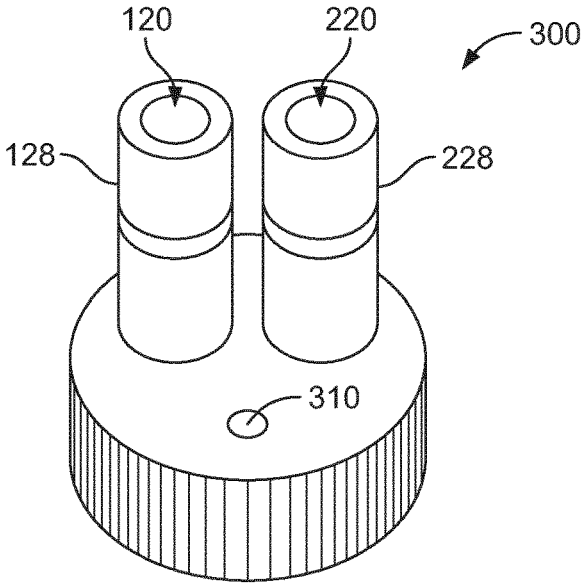
FIGS. 8A-B are perspective views of the cap of the liquid dispensing apparatus illustrated in FIG. 7.
Figure 8B:
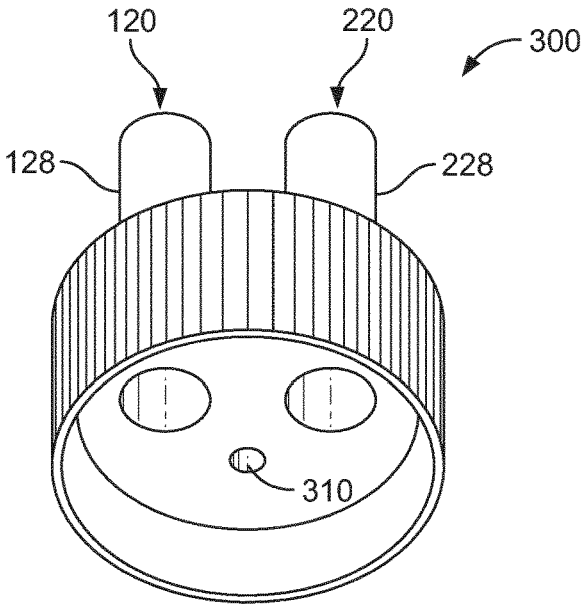

As illustrated in FIG. 8, the cap 300 also comprises a vent 310. FIGS. 8A and 8B are two perspective views of the cap 300. The vent 310 allows air to enter the liquid dispensing apparatus 100. In some embodiments, the vent 310 runs from the outside of the cap 300 into one more or the first container 110 and the second container 200. The cap 300 may comprise a single vent 310 which branches into each of the first container 110 and the second container 200. Alternatively, the cap 300 may comprise multiple vents 310, each running to one of the first container 110 or the second container 200. In the case where the first container 110 and the second container 200 are deformable bags or pouches, the vent may only run into the liquid dispensing apparatus 100 and not directly into first container 110 and the second container 200. In this embodiment, the vent allows air to enter the liquid dispensing apparatus, thereby reducing the pressure on the outside of the first container 110 and the second container 200, allowing the first container 110 and the second container 200 to return to their original shape when any external force or pressure applied to them is removed.

In some embodiments, the vent 310 comprises a valve to prevent liquid exiting through the vent. In this way, only air can pass through the vent 310 into the liquid dispensing apparatus 100.

Thus there has now been described another example of a liquid dispensing apparatus that can be used to dispense first and second liquids having differing tastant concentrations for consumption by a user in such a manner that sequential delivery of beverage components having differing tastant concentrations allows the user to perceive the beverage as a single beverage having a consistent flavour.

FIG. 9 is a schematic cross-section view of another example of a liquid dispensing apparatus 100, with like components shown with the same reference sign as those used in FIGS. 4-8. In the embodiment shown in FIG. 9, the second container 200 comprises a tube 202 and a fluid retaining element 204. The opening 225 at the first end 220 of the first container 200 is located at a first end 220 of the tube 202. The tube 202 then passes through the first container 110 such that a second end 205 of the tube 202 is located within the fluid retaining element 204, with the fluid retaining element 204 containing the second fluid 290. In the illustrated example, the second end 205 of the tube 202 is located towards the second end 230 of the second container 200. In alternative examples the second end 205 of the tube 202 may be located at an end of the fluid retaining element 204 adjacent to the first fluid container 110.

The arrangement of the first container 110 and the tube 202 of the second container 200 are such that, when the first liquid 190 and the second liquid 290 are poured from the liquid dispensing apparatus 100, the first liquid 190 flows through the opening 125 in the first end 120 of the first container 110 and the second liquid 290 flows through the opening 225 at the first end 220 of the tube 202 of the second container 200, such that the first liquid 190 begins to exit the opening 125 in the first end 120 of the first container 110 before the second liquid 290 begins to exit the opening 225 at the first end 220 of the tube 202 of the second container 200.

Figure 9A:
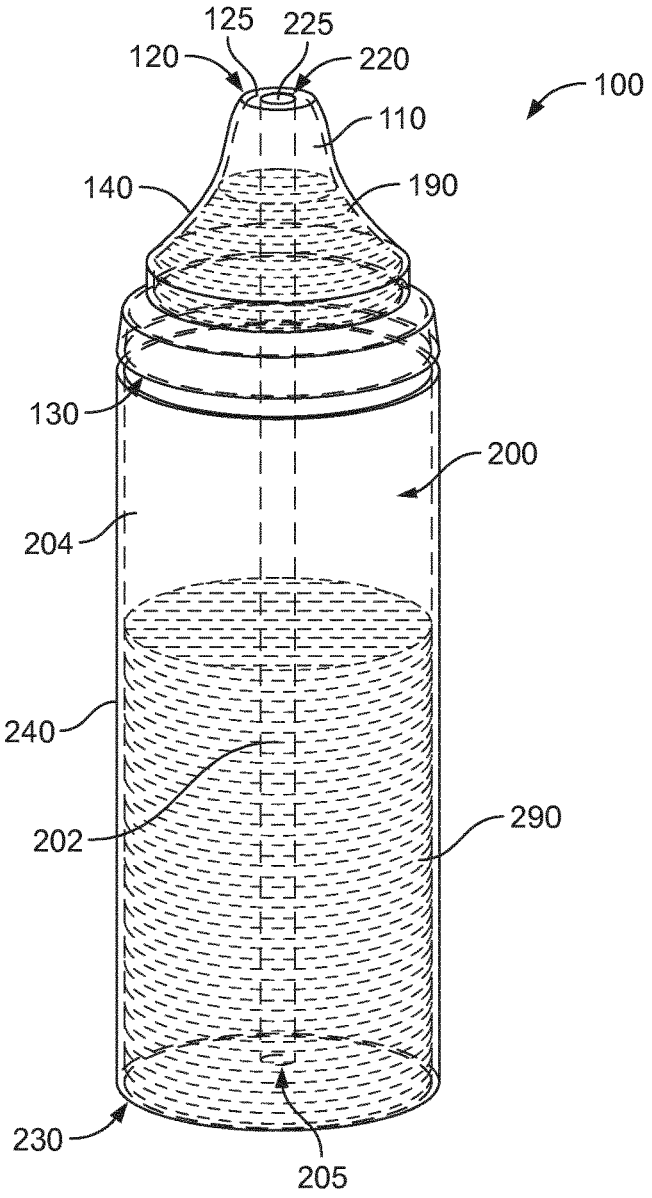
FIGS. 9A-B are schematic cross-section views of another example liquid dispensing apparatus.

Although illustrated as a cylinder in FIG. 9A, the fluid retaining element 204 may be any shape suitable for containing the second liquid 290, such as spherical, frustoconical or cubic. In FIG. 9A, the first container 110 is nipple shaped, however the first container 110 may be any shape suitable for containing the first liquid 190. In some embodiments, the first container is tapered towards the first end 120, thereby creating a mouthpiece which the user can easily fit in their mouths to prevent spillage of the first liquid 190 and the second liquid 290 when pouring from the liquid dispensing apparatus 100.

Figure 9B:
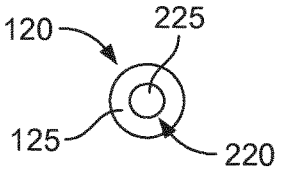

FIG. 9B is a cross-sectional view of the openings 125, 225 in the first end, 120, 220 of the first container 110 and tube 202 of the second container 200 respectively. As illustrated in FIG. 9B, the opening 125 in the first end 120 of the first container 110 forms an annulus around the opening 225 at the first end 220 of the tube 202 of the second container 200. Ion the present example the opening 225 in the first end 220 of the tube 202 of the second container 200 also has a smaller cross-sectional area than the opening 125 in the first end 120 of the first container 110. This also provides a restriction to the flow of the second liquid 290, thereby providing that the first liquid first liquid 190 begins to exit the opening 125 in the first end 120 of the first container 110 before the second liquid 290 begins to exit the opening 225 at the first end 220 of the tube 202 of the second container 200.

In the embodiment shown in FIG. 9, the first container is resiliently deformable. For example, the first container 110 may be manufactured from a rubber or a soft plastics material to enable it to be easily deformed by the user, for example by squeezing the side walls 140 of the first container 110 with their hands or, if the first container 110 is inserted into the user's mouth, their lips or teeth.

Figure 10A:
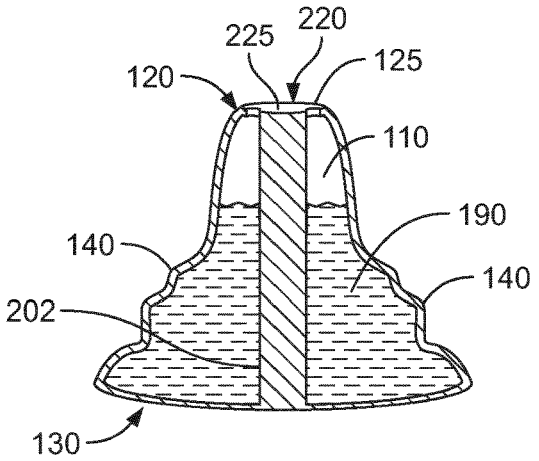
FIGS. 10A-C are a series of schematic cross-sections of the first container of the liquid dispensing apparatus illustrated in FIG. 9 in use.
Figure 10B:
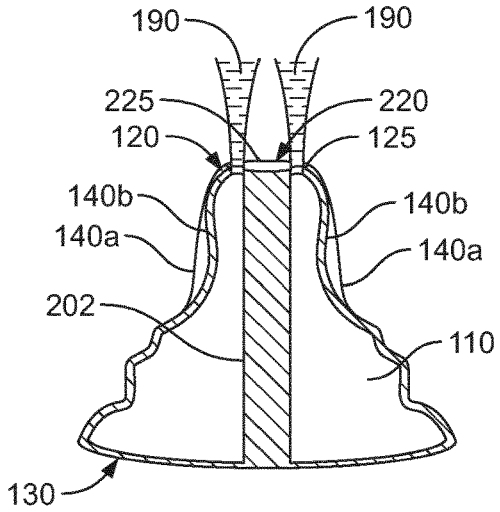
Figure 10C:
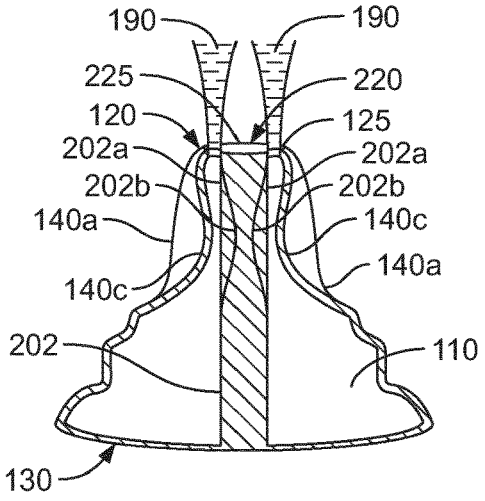

FIGS. 10A-C are a series of schematic cross-sections of the first container 110 of the liquid dispensing apparatus 100 illustrated in FIG. 9 in use. FIG. 10A shows the first container 110 in an undeformed state. As illustrated, in the undeformed state the first liquid 190 is entirely contained within the first container 110.

FIG. 10B shows the first container 110 in a deformed state. In FIG. 10B, the side walls 140*a* of the first container 110 represent the shape of the first container 110 in the undeformed state whilst the side walls 140*b* of the first container 110 represent the shape of the first container in the deformed state. As shown in FIG. 10B, when the first container 110 is deformed, for example by applying a force to the side walls 140 of the first container 110, the side walls are deformed from their initial position 140*a* to a new position 140*b* closer to the interior of the first container 110 and the tube 202 of the second container 200. Deforming the first container 110 in this manner causes the first liquid 190 to flow through the opening 125 in the first end 120 of the first container 110. For example, by deforming the side walls inwards, the volume of the first container 110 is decreased, causing the fluid level of the first liquid to rise until it reaches the opening 125 in the first end 120 of the first container 110. Alternatively, the first liquid 190 may be held in the first container 110 by a surface tension effect, particularly if the first end 120 of the first container 110 is inverted (pointing downwards), such as to avoid the first liquid 190 freely flowing from the opening 125 under the influence of gravity. Deforming the first container 110 in the above described manner provides a force to overcome the surface tension force, thereby allowing the first liquid to flow through the opening 125 in the first end 120 of the first container 110. When the force is removed from the side walls of the first container 110, the side walls return to their undeformed, initial position 140*a* and the first liquid 190 stops flowing through the opening 125 in the first end 120 of the first container 110.

In some embodiments, deforming the first container 110 causes a portion of the first liquid 190 to flow through the opening 125 in the first end 120 of the first container 110. For example, when a force is applied to the first container 110, the side walls 140 of the first container 110 are deformed from their initial position 140*a* to their new position 140*b*, causing a portion of the first liquid 190 to flow out of the opening 125 in the first end 120 of the first container 110. When the side walls 140 are in their new, deformed position 140*b*, this creates a constriction or neck in the first container 110, preventing any more of the first liquid from flowing out of the opening 125 in the first end 120 of the first container 110. In this arrangement, in order for more of the first liquid to flow out of the opening 125 in the first end 120 of the first container 110, the force on the first container must be removed, the side walls 140 allowed to return to their undeformed, initial position 140*a*, and a force reapplied to the side walls 140. This causes the side walls 140 to be deformed from their initial position 140*a* back to their deformed position 140*b*, causing a second portion of the first liquid 190 to flow out of the opening 125 in the first end 120 of the first container 110. In some embodiments, the first container 110 needs to be deformed more in order to get the second portion of the liquid 190 to flow out of the opening 125 in the first end 120 of the first container 110 than was required to get the first portion of the liquid 190 to flow out of the opening 125 in the first end 120 of the first container 110. Each subsequent portion of the first liquid 190 will then require more deformation of the first container 110 in order for the portion of the first liquid 190 to flow out of the opening 125 in the first end 120 of the first container 110.

In some embodiments, suction at the opening 125 in the first end 120 of the first container is required in order for the first liquid 190 to flow out of the opening 125 in the first end 120 of the first container. As described above, the first liquid 190 may be held in the first container 110 by a surface tension effect. Suction at the opening 125 in the first end 120 of the first container 110 provides a force to overcome this surface tension effect, thereby allowing the first liquid 190 to flow out of the opening 125 in the first end 120 of the first container 110. If the first container is resiliently deformable, applying suction at the opening 125 in the first end 120 of the first container 110 may also cause the first container 110 to deform due the pressure difference between the inside and the outside of the first container 110.

In some embodiments, suction at the opening 125 in the first end 120 of the first container 110 causes a predetermined amount of the first liquid 190 to flow out of the opening 125 in the first end 120 of the first container 110. For example, if the first container 110 is not resiliently deformable, applying suction at the opening 125 in the first end 120 of the first container 110 will cause a predetermined amount of the first liquid 190 to flow out of the opening 125 in the first end 120 of the first container 110, but a larger amount of suction at the opening 125 in the first end 120 of the first container 110 will be required in order for any more of the first liquid 190 to flow out of the opening 125 in the first end 120 of the first container 110. Alternatively, if the first container is resiliently deformable, as described above in relation to FIG. 10B, applying suction at the opening 125 in the first end 120 of the first container 110 will cause the side walls 140 of the first container 110 to be deformed from their initial position 140*a* to their new position 140*b*, causing a portion of the first liquid 190 to flow out of the opening 125 in the first end 120 of the first container 110. When the side walls are in their new, deformed position 140*b*, this creates a constriction or neck in the first container, preventing any more of the first liquid from flowing out of the opening 125 in the first end 120 of the first container 110. In this example, in order for more of the first liquid to flow out of the opening 125 in the first end 120 of the first container 110, the suction at the opening 125 in the first end 120 of the first container 110 must be removed, the side walls 140 allowed to return to their undeformed, initial position 140*a*, and suction reapplied to the opening 125 in the first end 120 of the first container 110.

In some embodiments, suction at the opening 225 in the first end 220 of the tube 202 of the second container 200 is required in order for the second liquid 290 to flow out of the opening 225 in the first end 220 of the tube 202 of the second container 200. In this case, more or less suction is required at the opening 225 in the first end 220 of the tube 202 of the second container 200 in order for the second liquid 290 to flow out of the opening 225 in the first end 220 of the tube 202 of the second container 200 than is required at the opening 125 in the first end 120 of the first container 110 in order for the first liquid 190 to flow out of the opening 125 in the first end 120 of the first container 110. For example, if more suction is required at the opening 225 in the first end 220 of the tube 202 of the second container 200 in order for the second liquid 290 to flow out of the opening 225 in the first end 220 of the tube 202 of the second container 200 than is required at the opening 125 in the first end 120 of the first container 110 in order for the first liquid 190 to flow out of the opening 125 in the first end 120 of the first container 110, then when suction is initially applied, the first liquid 190 will begin to flow out of the opening 125 in the first end 120 of the first container 110 before the second liquid 290 begins to flow out of the opening 225 in the first end 220 of the tube 202 of the second container 200. If the same amount of suction continues to be applied, then the first liquid 190 and the second liquid 290 will both flow out of the liquid dispensing apparatus 100. In the case described above where suction at the opening 125 in the first end 120 of the first container 110 causes a predetermined amount of the first liquid 190 to flow out of the opening 125 in the first end 120 of the first container 110, once the predetermined amount of the first liquid 190 has flowed out of the opening 125 in the first end 120 of the first container 110, the first liquid stops flowing out of the opening 125 in the first end 120 of the first container 110 regardless of whether more suction is applied. Accordingly, if the suction is maintained, for example by a user putting the first container 110 in their mouth and sucking on the first ends 120, 220 of the first container 110 and the tube 202 of the second container 200 respectively, the second liquid 290 will continue to flow out of the liquid dispensing apparatus 100 whilst none of the first liquid flows out of the liquid dispensing apparatus. Once the user has had the desired amount of beverage, for example a sip or a mouthful, the user can stop applying suction to the first ends 120, 220 of the first container 110 and the tube 202 of the second container 200 respectively and the second liquid will stop flowing out of the liquid dispensing apparatus 100. When the user wishes to use the liquid dispensing apparatus 100 for a second time, for example to have a second sip or mouthful, they can put the first container 110 in their mouth again and suck on the first ends 120, 220 of the first container 110 and the tube 202 of the second container 200 respectively. As described above, by removing and reapplying the suction, this causes a second portion of the first liquid 190 to flow out of the opening 125 in the first end 120 of the first container 110. As more suction is required at the opening 225 in the first end 220 of the tube 202 of the second container 200 in order for the second liquid 290 to flow out of the opening 225 in the first end 220 of the tube 202 of the second container 200 than is required at the opening 125 in the first end 120 of the first container 110 in order for the first liquid 190 to flow out of the opening 125 in the first end 120 of the first container 110, the second portion of the first liquid 190 begin to flow out of the opening 125 in the first end 120 of the first container 110 before the second liquid 290 begins to flow out of the opening 225 in the first end 220 of the tube 202 of the second container 200. As the suction is maintained, the second liquid 290 will continue to flow out of the liquid dispensing apparatus 100 whilst none of the first liquid flows out of the liquid dispensing apparatus. The user can repeat this sequence for every sip or mouthful of beverage they wish to consume until the first liquid 190 and/or the second liquid 290 are depleted from the first container 110 and the fluid retaining element 204 of the second container 200 respectively.

In some embodiments, deforming the first container 110 inhibits the flow of the second liquid 290 through the opening 225 in the first end 220 of the tube 202 of the second container 200. As illustrated in FIG. 100, the tube 202 of the second container 200 is resiliently deformable. When a force is applied to the first container 110, the side walls 140 of the first container are deformed from their initial position 140*a* to a new position 140*c*. Position 140*c* may be the same as position as position 140*b*, or it may be different, for example position 140*c* may be deformed away from the undeformed position 140*a* more than position 140*b*. Deforming the first container in this manner causes the tube 202 of the second container 200 to be deformed and inhibit the flow of the second liquid 290 out of the opening 225 in the first end 220 of the tube 202 of the second container 200. As illustrated in FIG. 100, deforming the first container 110 causes the tube 202 of the second container 200 to be deformed from an initial, undeformed position 202*a* to a new, deformed position 202*b*. This new, deformed position 202*b* creates a constriction or neck in the tube 202 of the second container 200, thereby restricting, inhibiting or entirely preventing the flow of the second liquid 290 out of the opening 225 in the first end 220 of the tube 202 of the second container 200.

Figure 11:
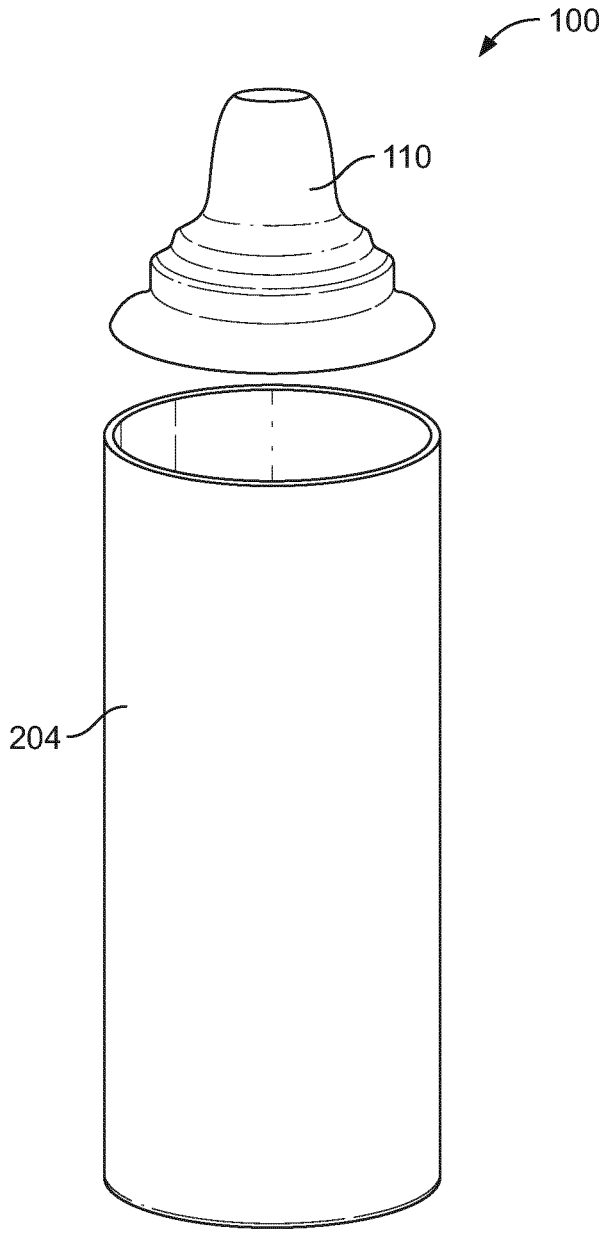
FIG. 11 is an exploded cross-section view of the example liquid dispensing apparatus illustrated in FIG. 9.

As illustrated in FIG. 11, the first container 110 is removable from the fluid retaining element 204 of the second container 200 to allow the first liquid 190 in the first container 110 and the second liquid 290 in the fluid retaining element 204 of the second container 200 to be replenished. The first container may be attached to the fluid retaining element 204 of the second container 200 by any suitable attachment means, for example a snap-fit joint, a screw threw or a hinge mechanism with a retaining means such as a latch or clip. Although not illustrated in FIG. 11, in some embodiments the tube 202 of the second container 200 is fixed to the first container 110, such that when the first container 110 is removed from the fluid retaining element 204 of the second container 200, the tube 202 of the second container 200 is integral with the first container 110. Alternatively, the tube 202 of the second container 200 may be fixed to the fluid retaining element 204 of the second container 200, such that the first container 110 is slid over and around the tube 202 of the second container 200 when the first container 110 is removed from and attached to the fluid retaining element 204 of the second container 200. Alternatively, the tube 202 of the second container 200 may be a separate component from the first container 110 and the fluid retaining element 204 of the second container 200 such that it is removable from the fluid retaining element 204 of the second container 200 separately from the first container 110. For example, the first container 110 may be removed from the fluid retaining element 204 of the second container 200, for example by unscrewing, then the tube removed from the fluid retaining element 204 of the second container 200. Once the first liquid 190 and the second liquid 290 have been replenished in the first container and the fluid retaining element 204 of the second container 200 respectively, the first container is screwed back onto the fluid retaining element 204 of the second container 200 before the tube is slide through the opening 125 in the first end 120 of the first container 110 such that the first end 220 of the tube 202 of the second container is adjacent to the first end 120 of the first container 110 and the second end 205 of the tube 202 of the second container is located within the fluid retaining element 204 of the second container 200.

In some embodiments, the first container 110 is removable from the fluid retaining element 204 of the second container 200 to allow the second liquid 209 in the fluid retaining element 204 of the second container 200 to be replenished. A replacement first container 110 containing the first liquid 190 is then reattached to the fluid retaining element 204 of the second container 200. In the embodiment where the tube 202 of the second container 200 is a separate component to the first component or the fluid retaining element 204 of the second container 200, or the embodiment where the tube 202 of the second container 200 is fixed to the first container 110, a replacement tube is also reattached.

Although not illustrated in the figures, the liquid dispensing apparatus 100 illustrated in FIG. 9 may also comprising a cap 300 configured to seal the opening 125 in the first end 120 of the first container 110 and the opening 225 at the first end 220 of the tube 202 of the second container 200, thereby preventing liquid from exiting the liquid dispensing apparatus 300 accidentally. The cap 300 may be rigid so as to prevent accidental deformation of the first container 110.

Thus there has now been described another example of a liquid dispensing apparatus that can be used to selectively dispense first and second liquids in order, the first and second liquids having differing tastant components or amounts such that when the user drinks from the apparatus the user receives the beverage components in order but in such manner as to allow the user to perceive the beverage as a single beverage having a consistent flavour.

In each or any of the examples described above, the delivery of the first liquid 190 and the second liquid 290 may be sequential and/or overlapping. For overlapping delivery, the dirt liquid 190 continues to flow out of the opening 125 of the first container 110 whilst the second liquid 290 begins to flow out of the opening 225 of the second container 200. In other words, the delivery of the first liquid 190 out of the liquid dispensing apparatus 100 overlaps with the delivery of the second liquid 290 out of the liquid dispensing apparatus 100. In alternative approaches, the first liquid 190 may be depleted from the liquid dispensing apparatus 100 before the second liquid 290 begins to flow out of the second container 200. In other words, the delivery of the first liquid 190 out of the liquid dispensing apparatus 100 may be completed before the delivery of the second liquid 290 out of the liquid dispensing apparatus 100 commences. In dependency upon the tastant properties of the liquids and the tastant sensitivity of a tongue, the liquid dispensing apparatus may be configured to cause the first liquid 190 be depleted from the liquid dispensing apparatus 100 a very short period of time after the second liquid 290 begins to flow out of the opening 125 in the first end 120 of the first container 110, thereby minimising the overlap between the delivery of the first liquid 190 and the delivery of the second liquid 290, while also avoiding a gap between delivery of the first and second liquids.

As discussed above, one of the first liquid 190 and the second liquid 290 contains a tastant which is essentially absent from the other liquid, or is present in a relatively differing amount. The composition of the first liquid 190 and the second liquid 290 may be essentially the same from the concentration of the tastant. For example, the first liquid 190 and the second liquid 290 may be substantially identical in terms of fats, air, proteins, macronutrients and carbohydrates, such that the first liquid and the second liquid comprise the same components in the same relative proportions apart from the presence of the tastant in one of the liquids. The first liquid 190 and the second liquid 290 may be visually the same. For example, the first liquid 190 and the second liquid 290 may have the same visual appearance, such as the colour, structure, texture, or any other obviously and directly perceivable property without tasting or smelling, such that the first liquid 190 and the second liquid 290 appear to have the same composition for users of the liquid dispensing device. The density and/or viscosity of the first liquid 190 and the second liquid 290 may be substantially the same. As will be appreciated by the skilled reader, the detection of and sensitivity to different tastants may be explained by the principle of chemesthesis.

The tastant may be sweet, salty, bitter, umami, sour or have flavour. For example, a salty tastant may consist of one or more of sodium chloride, potassium chloride and ammonium chloride. A sweet tastant may consist of one or more of glucose, sucrose, fructose or galactose.

The second liquid 290 may be a medicine, a nutraceutical or a dietary supplement. In this case, second liquid may have a bitter or sour tastant associated with the composition of the medicine, the nutraceutical or the dietary supplement. This tastant may be essential absent from the first liquid 190. When the first liquid 190 and the second liquid 290 are delivered from the liquid dispensing apparatus 100, for example into the mouth of a user, the first liquid 190 flows out of the liquid dispensing apparatus 100 before the second liquid 290. The user therefore tastes the first liquid 190 before the bitter or sour second liquid 290, given the user a more pleasant taste experience than if the second liquid 290 were delivered at the same time or before the first liquid 190.

The tastant in the beverage of the invention may comprise sodium chloride, for example the tastant may be sodium chloride. Humans have added common salt (sodium chloride) to their food for thousands of years and have grown accustomed to its taste. As a result, the most desirable saltiness profile is that obtained with sodium chloride. Sodium chloride can act to enhance the overall flavour of the food. The beverage according to the invention may contain 140 mg of sodium or less per 100 g of the total beverage. The U.S. Food and Drug Administration define meals and main dishes to be "low in sodium" if they contain 140 mg or less of sodium per 100 g.

The tastant in the beverage of the invention may comprise sucrose, for example the tastant may be sucrose or other sweetness component.

In the beverage to be dispensed from the apparatus of the present examples, part of the first liquid and the part of the second liquid may consumable together followed by another part of the first liquid and another part of the second liquid together. For example the beverage may be such that a part of the first portion may be consumable with a part of the second portion in a series of such combinations, for example a series of at least 3 combinations, for example a series of at least 5 combinations, for example series of at least 10 combinations. The beverage of the invention may be such that the majority of the second portion by volume is consumable in a series of combinations comprising (for example consisting of) part of the first portion and part of the second portion together. Such combinations can be delivered by adjusting the relative flow rates of the first and second liquids from the different containers within the apparatus so as to alter the flow overlap of the two liquids as discussed above.

Aspects of the subject matter described herein are set out in the following numbered clauses:

1. A liquid dispensing apparatus comprising:
a first container containing a first liquid, the first container having an opening in an end of the first container;
a second container adjacent to the first container, the second container containing a second liquid, the second container having an opening in an end of the second container,
wherein the opening in the end of the first container is proximate to the opening in the end of the second container, wherein the first container and the second container separate the first liquid from the second liquid; and
wherein one of the first liquid and the second liquid contains a tastant which is essentially absent from the other liquid or is present in a relatively differing amount;
wherein the arrangement of the first container and the second container, and/or the arrangement of the opening in the end of the first container and the opening in the end of the second container are such that, when the first and the second liquids are poured from the apparatus, the first liquid flows through the opening in the end of the first container and the second liquid flows through the opening in the end of the second container, such that the first liquid begins to exit the opening in the end of the first container before the second liquid begins to exit the opening in the end of the second container.

2. The liquid dispensing apparatus of clause 1, wherein the tastant is sweet, salty, bitter, umami, sour or has a flavour, for example wherein the tastant is selected from a list comprising sodium chloride, potassium chloride, ammonium chloride, glucose, sucrose, fructose or galactose.

3. The liquid dispensing apparatus of clause 1 or clause 2, wherein a side wall of the first container also forms a side wall of the second container.

4. The liquid dispensing apparatus of clause 3, wherein the side wall of the first container and the second container is curved so as to inhibit the flow of the second liquid from the second container.

5. The liquid dispensing apparatus of clause 3 or clause 4, wherein the side wall of the first container and the second container is curved so as to only allow a predetermined portion of the first liquid to flow to and exit the opening in the end of the first container when the liquid dispensing apparatus is rotated through a first angle.

6. The liquid dispensing apparatus of clause 5, wherein a second predetermined portion of the first liquid is allowed to flow to and exit the opening in the end of the first container when the liquid dispensing apparatus is rotated through a second angle, wherein the second angle is greater than the first angle.

7. The liquid dispensing apparatus of any one of clauses 3 to 6, wherein the first container tapers towards the opening in the end of the first container and the second container tapers towards the opening in the end of the second container.

8. The liquid dispensing apparatus of clause 7, wherein the taper of the first container and the second container is asymmetric such as to promote the liquid dispensing apparatus to be held in a particular orientation when the first and the second liquids are poured from the apparatus.

9. The liquid dispensing apparatus of any one of clauses 3 to 8, wherein the opening in the end of the first container and the opening in the end of second container are located in a cap, wherein the cap is removable from the liquid dispensing apparatus to allow the first liquid in the first container and the second liquid in the second container to be replenished.

10. The liquid dispensing apparatus of any one of clauses 3 to 9, wherein the opening in the end of the second container has a smaller cross-sectional area than the opening in the first container.

11. The liquid dispensing apparatus of any one of clauses 3 to 10, wherein the volume of the first liquid in the first container is greater than the volume of the second liquid in the second container.

12. The liquid dispensing apparatus of any one of clauses 1 to 3, wherein the opening in the end of the first container comprises a first valve and the opening in the end of the second container comprises a second valve.

13. The liquid dispensing apparatus of clause 12, wherein the maximum flow of the first liquid through the first valve is greater than the maximum flow of the second liquid through the second valve 14. The liquid dispensing apparatus of any one of clauses 12 to 13, wherein the first valve is configured to only allow a predetermined portion of the first liquid exit the first valve and/or the second valve is configured to only allow a predetermined portion of the second liquid exit the second valve.

15. The liquid dispensing apparatus of clause 14, wherein the predetermined portion of the first liquid is less than the predetermined portion of the second liquid.

16. The liquid dispensing apparatus of any one of clauses 12 to 15, wherein the each of the first valve and the second valve has an open position and a closed position.

17. The liquid dispensing apparatus of clause 16, wherein the first valve is configured to transition from the open position to the closed position and/or from the closed position to the open position faster than the second valve.

18. The liquid dispensing apparatus of clause 16, wherein the first valve and the second valve form part of a composite valve such that the first valve and the second valve are configured to transition from the open position to the closed position simultaneously and from the closed position to the open position simultaneously.

19. The liquid dispensing apparatus of any one of clauses 16 to 18, wherein the first valve and/or the second valve are biased in the closed position.

20. The liquid dispensing apparatus of clause 19, wherein a pressure difference across the valve is required in order to overcome the bias.

21. The liquid dispensing apparatus of any one of clauses 12 to 20, wherein the first valve and the second valve are located in a cap, wherein the cap is removable from the liquid dispensing apparatus to allow the first liquid in the first container and the second liquid in the second container to be replenished.

22. The liquid dispensing apparatus of clause 21, wherein the cap comprises a vent to allow air to enter the liquid dispensing apparatus, for example the first container and/or the second container.

23. The liquid dispensing apparatus of clause 22, wherein the vent comprises a valve to prevent liquid exiting through the vent.

24. The liquid dispensing apparatus of clause 1 or clause 2, wherein the second container comprises a tube and fluid retaining element, wherein:

the opening in the end of the second container is located at an first end of the tube;

a second end of the tube is located within the fluid retaining element;

the fluid retaining element contains the second liquid; and the tube passes through the first container.

25. The liquid dispensing apparatus of clause 24, wherein the first container is resiliently deformable.

26. The liquid dispensing apparatus of clause 25, wherein deforming the first container causes the first liquid to flow through the opening in the end of the first container.

27. The liquid dispensing apparatus of clause 26, wherein deforming the first container causes a portion of the first liquid to flow through the opening in the end of the first container.

28. The liquid dispensing apparatus of any one of clauses 25 to 27, wherein deforming the first container inhibits the flow of the second liquid through the opening in the first end of the tube of the second container.

29. The liquid dispensing apparatus of any one of clauses 25 to 28, wherein the tube of the second container is resiliently deformable, and wherein deforming the first container causes the tube of the second container to be deformed and inhibit the flow of the second liquid out of the opening in the first end of the tube of the second container.

30. The liquid dispensing apparatus of any one of clauses 24 to 29, wherein suction at the opening in the end of the first container is required in order for the first liquid to flow out of the opening in the end of the first container.

31. The liquid dispensing apparatus of clause 30, wherein suction at the opening in the end of the first container causes a predetermined amount of the first liquid to flow out of the opening in the end of the first container.

32. The liquid dispensing apparatus of clause 30 or clause 31, wherein suction at the opening in the first end of the tube of the second container is required in order for the second liquid to flow out of the opening in the first end of the tube of the second container.

33. The liquid dispensing apparatus of clause 32, wherein more or less suction is required at the opening in the first end of the tube of the second container in order for the second liquid to flow out of the opening in the first end of the tube of the second container than is required at the opening in the end of the first container in order for the first liquid to flow out of the opening in the end of the first container.

34. The liquid dispensing apparatus of any one of clauses 24 to 33, wherein the first container is removable from the fluid retaining element of the second container to allow the first liquid in the first container and the second liquid in the fluid retaining element of the second container to be replenished.

35. The liquid dispensing apparatus of clause 34, wherein the tube of the second container is fixed to the first container.

36. The liquid dispensing apparatus of any one of clauses 24 to 33, wherein the first container is removable from the fluid retaining element of the second container to allow the second liquid in the fluid retaining element of the second container to be replenished and a replacement first container reattached to the fluid retaining element of the second container.

37. The liquid dispensing apparatus of any one of clauses 24 to 36, wherein the opening in the end of the first container forms an annulus around the opening at the first end of the tube of the second container.

38. The liquid dispensing apparatus of any one of clauses 24 to 37, further comprising a cap configured to seal the opening in the end of the first container and the opening at the first end of the tube of the second container.

39. A liquid dispensing apparatus comprising:

a first container containing a first liquid, the first container having an opening in an end of the first container;

a second container adjacent to the first container, the second container containing a second liquid, the second container having an opening in an end of the second container, wherein the opening in the end of the first container is proximate to the opening in the end of the second container, wherein a curved side wall of the first container also forms a curved side wall of the second container, the curved side wall separating the first liquid from the second liquid; and wherein one of the first liquid and the second liquid contains a tastant which is essentially absent from the other liquid or is present in a relatively differing amount;

wherein the curved side wall inhibits the flow of the second liquid from the second container such that, when the first and the second liquids are poured from the apparatus, the first liquid flows through the opening in the end of the first container and the second liquid flows through the opening in the end of the second container, such that the first liquid begins to exit the opening in the end of the first container before the second liquid begins to exit the opening in the end of the second container.

40. A liquid dispensing apparatus comprising:

a first container containing a first liquid, the first container having an opening in an end of the first container;

a second container adjacent to the first container, the second container containing a second liquid, the second container having an opening in an end of the second container, wherein the opening in the end of the first container is proximate to the opening in the end of the second container, wherein the first container and the second container separate the first liquid from the second liquid; and wherein one of the first liquid and the second liquid contains a tastant which is essentially absent from the other liquid or is present in a relatively differing amount;

wherein the opening in the end of the first container comprises a first valve and the opening in the end of the second container comprises a second valve, the first valve and the second valve configured such that, when the first and the second liquids are poured from the apparatus, the first liquid flows through the first valve and the second liquid flows through the second valve, such that the first liquid begins to exit the first valve before the second liquid begins to exit the second valve.

41. A liquid dispensing apparatus comprising:

a first container containing a first liquid, the first container having an opening in an end of the first container;

a second container comprising a tube and a fluid retaining element, the fluid retaining element containing a second liquid, the tube having an opening at a first end of the tube and a second end of the tube being within the fluid retaining element, wherein the tube passes through the first container;

wherein the opening in the end of the first container is proximate to the opening at the first end of tube of the second container, wherein the first container and the second container separate the first liquid from the second liquid; and wherein one of the first liquid and the second liquid contains a tastant which is essentially absent from the other liquid or is present in a relatively differing amount;

wherein the arrangement of the first container and the tube of the second container are such that, when the first and the second liquids are poured from the apparatus, the first liquid flows through the opening in the end of the first container and the second liquid flows through the opening at the first end of the tube of the second container, such that the first liquid begins to exit the opening in the end of the first container before the second liquid begins to exit the opening at the first end of the tube of the second container.

The skilled person will appreciate that these embodiments are provided only by way of example, and different features from different embodiments can be combined as appropriate without departing from the spirit and scope of the present teachings. Accordingly, the scope of the presently claimed invention is to be defined by the appended claims and their equivalents.

The invention claimed is:

1. A liquid dispensing apparatus comprising:

a first container containing a first liquid, the first container having an opening in an end of the first container;

a second container adjacent to the first container, the second container containing a second liquid, the second container having an opening in an end of the second container, the opening in the end of the first container is proximate to the opening in the end of the second container, the first container and the second container separate the first liquid from the second liquid;

one of the first liquid and the second liquid contains a tastant which is essentially absent from the other liquid or is present in a relatively differing amount; and the arrangement of the first container and the second container, and/or the arrangement of the opening in the end of the first container and the opening in the end of the second container are such that, when the first and the second liquids are poured from the apparatus, the first liquid flows through the opening in the end of the first container and the second liquid flows through the opening in the end of the second container, such that the first liquid begins to exit the opening in the end of the first container before the second liquid begins to exit the opening in the end of the second container, the tastant is selected from the group consisting of sodium chloride, potassium chloride, ammonium chloride, glucose, sucrose, fructose and galactose, and a ratio of a concentration of the tastant in the first liquid to an overall concentration of the tastant in a beverage is between 3:1 and 1.1:1.

2. The liquid dispensing apparatus of claim 1, wherein a side wall of the first container also forms a side wall of the second container, and wherein the side wall of the first container and the second container is curved so as to inhibit the flow of the second liquid from the second container.

3. The liquid dispensing apparatus of claim 2, wherein: the side wall only allows a predetermined portion of the first liquid to flow to and exit the opening in the end of the first container when the liquid dispensing apparatus is rotated through a first angle; and a second predetermined portion of the first liquid is allowed to flow to and exit the opening in the end of the first container when the liquid dispensing apparatus is rotated through a second angle, wherein the second angle is greater than the first angle.

4. The liquid dispensing apparatus of claim 2, wherein the opening in the end of the first container and the opening in the end of second container are located in a cap, and the cap is removable from the liquid dispensing apparatus to allow the first liquid in the first container and the second liquid in the second container to be replenished.

5. The liquid dispensing apparatus of claim 1, wherein the opening in the end of the first container comprises a first valve and the opening in the end of the second container comprises a second valve.

6. The liquid dispensing apparatus of claim 5, wherein the first valve is configured to only allow a predetermined portion of the first liquid exit the first valve and/or the second valve is configured to only allow a predetermined portion of the second liquid exit the second valve.

7. The liquid dispensing apparatus of claim 5, wherein the first valve is configured to transition from an open position to a closed position and/or from the closed position to the open position faster than the second valve; or the first valve and the second valve form part of a composite valve such that the first valve and the second valve are configured to transition from the open position to the closed position simultaneously and from the closed position to the open position simultaneously.

8. The liquid dispensing apparatus of claim 5, wherein the first valve and/or the second valve are biased in the closed position and wherein a pressure difference across the valve is required in order to overcome the bias.

9. The liquid dispensing apparatus of claim 5, wherein the first valve and the second valve are located in a cap, wherein the cap is removable from the liquid dispensing apparatus to allow the first liquid in the first container and the second liquid in the second container to be replenished.

10. The liquid dispensing apparatus of claim 1, wherein the second container comprises a tube and fluid retaining element:

the opening in the end of the second container is located at a first end of the tube;

a second end of the tube is located within the fluid retaining element;

the fluid retaining element contains the second liquid; and the tube passes through the first container.

11. The liquid dispensing apparatus of claim 10, wherein the first container is resiliently deformable, and deforming the first container causes the first liquid to flow through the opening in the end of the first container.

12. The liquid dispensing apparatus of claim 11, wherein deforming the first container causes at least one of:

a portion of the first liquid to flow through the opening in the end of the first container; and the flow of the second liquid through the opening in the first end of the tube of the second container to be inhibited.

13. The liquid dispensing apparatus of claim 11, wherein the tube of the second container is resiliently deformable, and deforming the first container causes the tube of the second container to be deformed and inhibit the flow of the second liquid out of the opening in the first end of the tube of the second container.

14. The liquid dispensing apparatus of claim 10, wherein suction at the opening in the end of the first container is required in order for the first liquid to flow out of the opening in the end of the first container.

15. The liquid dispensing apparatus of claim 1, wherein the concentration of the tastant in the first liquid and a concentration of the tastant in the second liquid differs by at least 40%.

* * * * *